US006681160B2

(12) United States Patent
Bidaud

(10) Patent No.: US 6,681,160 B2
(45) Date of Patent: Jan. 20, 2004

(54) GEOMETRIC TRACK AND TRACK/ VEHICLE ANALYZERS AND METHODS FOR CONTROLLING RAILROAD SYSTEMS

(75) Inventor: Andre C. Bidaud, Burnaby (CA)

(73) Assignee: Andian Technologies Ltd., Burnaby (CA)

( * ) Notice: Subject to any disclaimer, the term of this patent is extended or adjusted under 35 U.S.C. 154(b) by 4 days.

(21) Appl. No.: 10/073,831

(22) Filed: Feb. 11, 2002

(65) Prior Publication Data

US 2002/0077733 A1 Jun. 20, 2002

Related U.S. Application Data

(63) Continuation-in-part of application No. 09/594,286, filed on Jun. 15, 2000, now Pat. No. 6,347,265.

(60) Provisional application No. 60/149,333, filed on Aug. 17, 1999, and provisional application No. 60/139,217, filed on Jun. 15, 1999.

(51) Int. Cl.[7] ..... B61L 23/04

(52) U.S. Cl. ..... 701/19; 73/146

(58) Field of Search ..... 701/19; 73/146

(56) References Cited

U.S. PATENT DOCUMENTS

| | | | |
|---|---|---|---|
| 3,381,626 | A | 5/1968 | Fagan et al. |
| 3,638,482 | A | 2/1972 | Schubert |
| 4,005,601 | A | 2/1977 | Botello |
| 4,691,565 | A | 9/1987 | Theurer |
| 4,741,207 | A | 5/1988 | Spangler |
| 4,793,577 | A | 12/1988 | Austill et al. |
| 4,880,190 | A | 11/1989 | Austill et al. |
| 5,332,180 | A | 7/1994 | Peterson et al. |
| 5,440,923 | A | 8/1995 | Arnberg et al. |
| 5,613,442 | A | 3/1997 | Ahola et al. |
| 5,786,998 | A | 7/1998 | Neeson et al. |
| 5,787,815 | A | 8/1998 | Andersson et al. |
| 5,867,404 | A | 2/1999 | Bryan |
| 5,956,664 | A | 9/1999 | Bryan |
| 5,987,979 | A | 11/1999 | Bryan |
| 6,044,698 | A | 4/2000 | Bryan |
| 6,125,311 | A | 9/2000 | Lo |
| 6,347,265 | B1 | 2/2002 | Bidaud |

FOREIGN PATENT DOCUMENTS

| | | |
|---|---|---|
| EP | 0 189 621 A1 | 8/1986 |
| FR | EP 0 561 705 A1 | 9/1993 |

*Primary Examiner*—Yonel Beaulieu
(74) *Attorney, Agent, or Firm*—Fay, Sharpe, Fagan, Minnich & McKee, LLP

(57) ABSTRACT

Track and track/vehicle analyzers for determining geometric parameters of tracks, determining the relation of tracks to vehicles and trains, analyzing the parameters in real-time, and communicating corrective measures to various control mechanisms are provided. In one embodiment, the track analyzer includes a track detector and a computing device. In another embodiment, the track/vehicle analyzer includes a track detector, a vehicle detector, and a computing device. In other embodiments, the track/vehicle detector also includes a communications device for communicating with locomotive control computers in lead units, locomotive control computers in helper units, and a centralized control office. Additionally, a method for determining and communicating an optimized control strategy is provided. A method for dynamically modeling vehicle behavior, determining probabilities for derailment, and communicating recommended actions is also provided. The analyzers improve operational safety and overall efficiency, including fuel efficiency, vehicle wheel wear, and track wear, in railroad systems.

36 Claims, 11 Drawing Sheets

FIG. 1
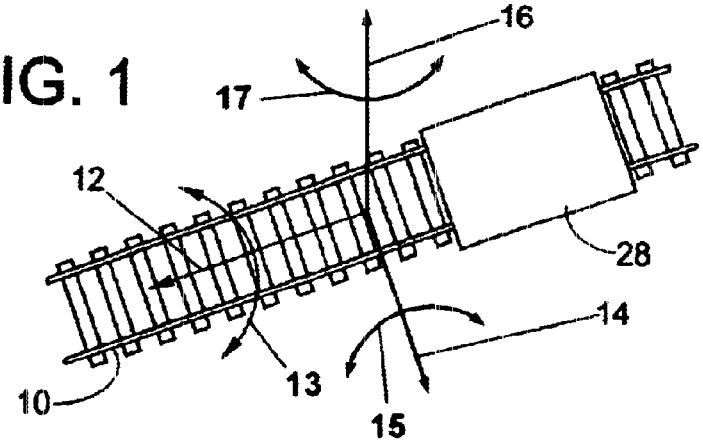
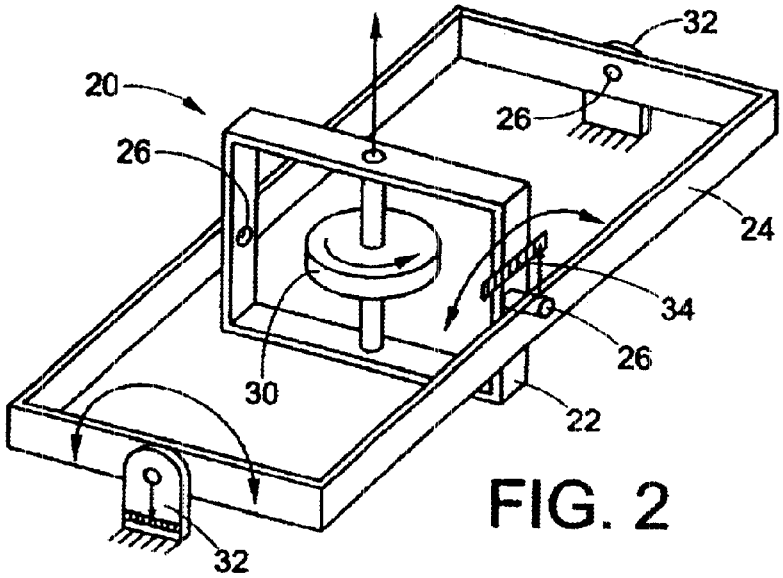
FIG. 2
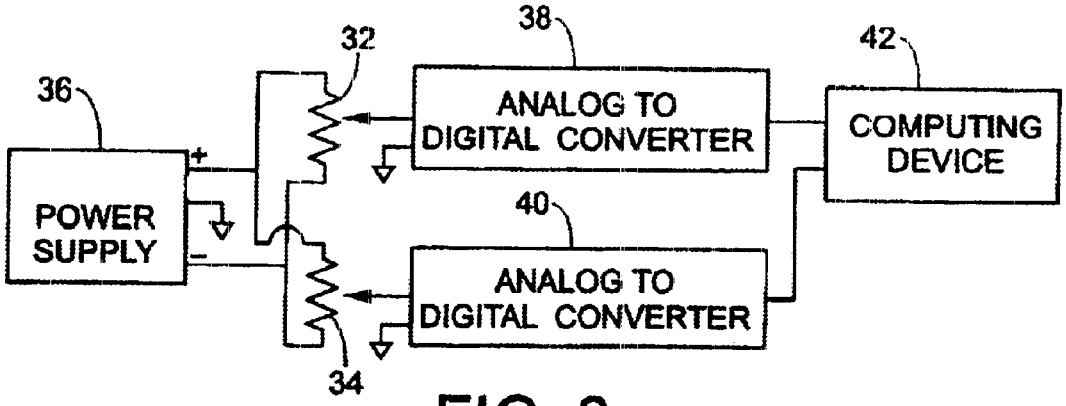
FIG. 3

GEOMETRIC TRACK AND TRACK/ VEHICLE ANALYZERS AND METHODS FOR CONTROLLING RAILROAD SYSTEMS

CROSS REFERENCE TO RELATED APPLICATIONS

This is a continuation-in-part application of prior application Ser. No. 09/594,286, filed on Jun. 15, 2000 now U.S. Pat No. 6,347,265, which claims the benefit of U.S. Provisional Application Ser. Nos. 60/139,217, filed Jun. 15, 1999, and 60/149,333, filed on Aug. 17, 1999, the disclosures of which are incorporated herein by reference.

BACKGROUND OF THE INVENTION

The invention relates to determining, recording, and processing a geometry of a railroad track, determining, recording, and processing a geometry of a vehicle traveling on the track, and using such information to control operation of one or more vehicles on the track and to effectuate maintenance of the track. It finds particular application in conjunction with using the geometric information to improve operational safety and overall efficiency (e.g., fuel efficiency, vehicle wheel wear, and track wear) and will be described with particular reference thereto. It will be appreciated, however, that the invention is also amendable to other like applications.

Heretofore, track geometry systems determine and record geometric parameters of railroad tracks used by vehicles (e.g., railroad cars and locomotives) and generate an inspection or work notice for a section of track if the parameters are outside a predetermined range. Each vehicle includes a body secured to a truck, which rides on the track. Conventional systems use a combination of inertial and contact sensors to indirectly measure and quantify the geometry of the track. More specifically, an inertial system mounted on the truck senses motion of the truck in relation to the track. A plurality of transducers measure relative motion of the truck in relation to the track.

One drawback of conventional systems is that a significant number of errors occur from transducer failures. Furthermore, significant errors also result from a lack of direct measurements of the required quantities in a real-time manner.

Furthermore, conventional inertial systems typically use off-the-shelf gyroscopes and other components, which are designed for military and aviation applications. Such off-the-shelf components are designed for high rates of inertial change found in military and aircraft applications. Therefore, components used in conventional systems are poorly suited for the relatively low amplitude and slow varying signals seen in railroad applications. Consequently, conventional systems compromise accuracy in railroad applications.

The current technology in locomotive traction control is based on an average North American curve of approximately 2.5 degrees. If real-time rail geometry data, including current curvature and cross-level (i.e., superelevation), can be provided, then the drive system can be optimized for current track conditions, resulting in maximum efficiency.

The relationship between the tractive force that drives the locomotive, or other type of vehicle, forward on a rail is expressed by the following equation:

$$F_{Traction}=F_{Normal}*u$$

where u is the coefficient of static friction and $F_{Normal}$ is the normal force at the rail/wheel interface.

Balance speed is the optimum speed of the vehicle at which the resultant force vector is normal to the rail. By maintaining a vehicle at its balanced speed point, $F_{Normal}$ is maximized. Accordingly, $F_{Traction}$ is also maximized when the vehicle is operated at its balanced speed. Furthermore, by maintaining the drive wheels at the highest point of static friction while operating at the balanced speed, the maximum amount of available tractive force ($F_{Traction}$) is achieved.

A small change in the velocity (V) through a curve results in significant changes in the lateral (centripetal) forces, as shown in the following equation:

$$F_{Lateral}=\text{Mass}*A_{lateral},$$

where $$A_{lateral}=(1/R_{curve})*V^2$$

No current system provides the information necessary to compute the balance speed and therefore determine the most efficient operation of the train. Additionally, no current device or system allows for the inspection of rail track structures, determination of track geometric conditions, and identification of track defects in real-time. Furthermore, no current device or system communicates such information to other locomotive control mechanisms (e.g., locomotive control computers) in real-time allowing for real-time locomotive control.

SUMMARY OF THE INVENTION

The invention provides a new and improved apparatus and method, which overcomes the above-referenced problems and others. The invention acquires and analyzes rail geometry information in real-time to provide drive control systems of trains and autonomous vehicles with information so locomotive control circuits can reduce flanging forces at the wheel/rail interface, thereby increasing the locomotive tractive force on a given piece of track. The net result is increased fuel efficiency, reduced vehicle wheel wear, and reduced rail wear. This optimizes the amount of tonnage hauled per unit cost for fuel, rail maintenance, and wheel maintenance.

Through inter-train communication, relevant track defect and traction control information can be communicated to lead units and helper units (i.e., locomotives) in the train. This permits the lead units and helper units to adjust control strategies to improve operational safety and optimize overall efficiency of the train.

Where the rail geometry information is collected and analysed in real-time against track standards, the results of the analysis are communicated to a display device (for use by the engineer), locomotive control computers, and a centralized control office as corrective measures, optizimized control strategies, and recommended courses of action. The locomotive control computers respond to such communications by taking appropriate actions to reduce risks of derailment and other potential hazards, as well as improving the overall efficiency of the train. The remote communications to the centralized control office also provide coordinated dispatch of personnel to perform maintenance for defects detected by the system, as well as a centralized archive of defect data for historical comparison.

In one embodiment, a track analyzer included on a vehicle traveling on a track is provided. In another embodiment, a track/vehicle analyzer included on a vehicle traveling on a track is provided. Methods for analyzing the track on which the vehicle is traveling in real-time using the track analyzer and the track/vehicle analyzer are provided. Additionally, several methods for improving the operational safety and economic efficiencies (e.g., fuel efficiency, vehicle wheel wear, and track wear) of the track and vehicles and/or trains traveling on the track using the track/vehicle analyzer are provided. A method for dynamically modeling behavior of a vehicle traveling on a track using the track/vehicle analyzer is also provided.

In one aspect of the invention, the track analyzer includes a track detector for determining track parameters comprising at least one parameter of a group including a grade of the track, a superelevation of the track, a gauge of the track, and a curvature of the track and a computing device for determining in real-time if the track parameters are within acceptable tolerances, and, if any one of the track parameters are not within acceptable tolerances, generating corrective measures.

In another aspect of the invention, the track/vehicle analyzer includes a track detector for determining track parameters, a vehicle detector for determining vehicle parameters comprising at least one parameter of a group including a speed of the vehicle relative to the track, a distance the vehicle has traveled on the track, forces on a drawbar of the vehicle, a set of global positioning system coordinates for the vehicle, and a set of orthogonal accelerations experienced by the vehicle, and a computing device for determining in real-time if the track parameters and the vehicle parameters are within acceptable tolerances and, if any one of the track parameters or the vehicle parameters are not within acceptable tolerances, generating corrective measures.

In still another aspect of the invention, a track/vehicle analyzer includes a track detector for determining track parameters, a vehicle detector for determining vehicle parameters, a computing device for a) determining a plurality of calculated parameters as a function of the track parameters and the vehicle parameters, b) determining in real-time if the track parameters, the vehicle parameters, and the calculated parameters are not within acceptable tolerances, and c) if any one of the track parameters, the vehicle parameters, or the calculated parameters are not within acceptable tolerances, generating corrective measures, and a communications device for communicating the corrective measures to a first locomotive control computer in a lead unit associated with the vehicle.

In yet another aspect of the invention, the calculated parameters include a balance speed parameter for the vehicle, and the computing device is also for determining in real-time if the track parameters, the vehicle parameters, and the calculated parameters associated with the balance speed parameter are within acceptable tolerances associated with the calculated balance speed parameter, and if any one of the track parameters, vehicle parameters, or calculated parameters associated with the balance speed parameter are not within acceptable tolerances associated with the calculated balance speed parameter, determining a first optimized control strategy for the vehicle, and the communications device is for communicating the first optimized control strategy to the first locomotive control computer.

In still yet another aspect of the invention, the vehicle detector includes a force determiner for determining the forces on the drawbar of the vehicle and the communications device is also for communicating the corrective measures to a second locomotive control computer in a helper unit of a train associated with the vehicle.

In another aspect of the invention, the communications device is also for communicating the corrective measures to a centralized control office.

In still another aspect of the invention, wherein the vehicle is a first vehicle and is associated with a train or traveling on the track as an individual vehicle, the track/vehicle analyzer also includes a look-up table for storing a train manifest associated with the train, a plurality of physical characteristics for each vehicle, and a plurality of operating characteristics for each vehicle over a range of operational situations. The communications device is also for communicating with an upcoming track feature including a feature selected from a group including a track switch and a track crossing to determine the condition of the feature. The computing device is also for a) dynamically modeling a behavior of each vehicle, b) identifying a vehicle with the highest statistical probability for a derailment under the track parameters for portions of the track currently being traveled, c) determining if the highest statistical probability exceeds a minimum acceptable probability, and d) if the highest statistical probability exceeds a minimum acceptable probability, determining a recommended course of action, including an optimized control strategy, to reduce the probability of derailment. The track/vehicle analyzer also includes a video display device for displaying the recommended course of action to an operator associated with the first vehicle. The communications device is also for communicating the recommended course of action to a locomotive control computer associated with the first vehicle. The computing device is also for determining that the vehicle with the highest probability for derailment has passed a portion of the track associated with the previous recommended course of action and the communications device is also for communicating a message to resume standard operations to the locomotive control computer.

In yet another aspect of the invention, the method for analyzing a track on which a vehicle is traveling includes: a) determining track parameters, b) determining in real-time if the track parameters are within acceptable tolerances, and c) if any one of the track parameters are not within acceptable tolerances, generating corrective measures.

In still yet another aspect of the invention, the method of analyzing a vehicle and a track on which the vehicle is traveling includes: a) determining track parameters, b) determining vehicle parameters, c) determining in real-time if the track parameters and the vehicle parameters are within acceptable tolerances, and d) if any one of the track parameters or the vehicle parameters are not within acceptable tolerances, generating corrective measures.

In another aspect of the invention, a method for improving operational safety and overall efficiency, including fuel efficiency, vehicle wheel wear, and track wear, for a track and a vehicle traveling on the track includes: a) determining track parameters, b) determining vehicle parameters, c) determining a plurality of calculated parameters as a function of the track parameters and the vehicle parameters, including balance speed parameter for the vehicle, d) determining in real-time if the track parameters, the vehicle parameters, and the calculated parameters associated with the balance speed parameter are within acceptable tolerances associated with the balance speed parameter, e) if any one of the track parameters, the vehicle parameters, or the calculated parameters associated with the balance speed parameter are not within acceptable tolerances, determining a first optimized control strategy for the vehicle, and f) communicating the first optimized control strategy, the track parameters, the vehicle parameters, and the calculated parameters to a locomotive control computer in a lead unit associated with the vehicle.

In still another aspect of the invention, a method for improving operational safety and overall efficiency, including fuel efficiency, vehicle wheel wear, and track wear, for a track and a train traveling on the track includes: a) determining track parameters, b) determining train parameters associated with a vehicle of the train including forces on a drawbar of the vehicle, c) determining a plurality of calculated parameters as a function of the track parameters and the train parameters, d) determining in real-time if the track parameters, the train parameters, and the calculated parameters are within acceptable tolerances, e) if any one of the track parameters, the train parameters, or the calculated parameters are not within acceptable tolerances, generating corrective measures, f) communicating the corrective measures to a locomotive control computer in a helper unit of the train.

In yet another aspect of the invention, a method for improving operational safety for a track and multiple independent vehicles traveling on the track includes: a) on a first vehicle traveling on the track, determining track parameters, b) on the first vehicle, determining vehicle parameters, c) determining a plurality of calculated parameters as a function of the track parameters and the vehicle parameters, d) on the first vehicle, determining in real-time if the track parameters, the vehicle parameters, and the calculated parameters are within acceptable tolerances, and e) if any one of the track parameters, the vehicle parameters, or the calculated parameters are not within acceptable tolerances, transmitting a message from the first vehicle to a centralized control office.

In still yet another aspect of the invention, the method for dynamically modeling a behavior of each vehicle associated with a train traveling on a track or for an individual vehicle traveling on the track includes: a) identifying a train manifest for the train, b) identifying a plurality of physical characteristics for each vehicle, c) identifying a plurality of operating characteristics for each vehicle over a range of operational situations, d) determining track parameters; e) determining vehicle parameters for a first vehicle; f) determining a plurality of calculated parameters to dynamically model the behavior of each vehicle; g) identifying a vehicle with the highest statistical probability for a derailment under the track parameters for portions of the track currently being traveled; h) determining if the highest statistical probability exceeds a minimum acceptable probability, and i) if the highest statistical probability exceeds a minimum acceptable probability, determining a recommended course of action, including an optimized control strategy, to reduce the probability of derailment.

One advantage of the invention is that it detects defects in rail track structures in real-time and determines corrective measures.

Another advantage of the invention is that real-time track and vehicle geometry data, balance speed data, and optimized control strategies can be communicated to locomotive control computers to improve operational safety and overall efficiency, including fuel efficiency, vehicle wheel wear, and track wear.

Another advantage of the invention is that notice of track defects, real-time track and vehicle geometry data, and recommended courses of action can be communicated to centralized control offices to improve operational safety.

Another advantage of the invention is that direct measurements of the required parameters increasing vehicle operational safety and efficiency because up to the minute information is available on current track conditions.

Still further features and advantages of the invention will become apparent to those of ordinary skill in the art upon reading and understanding the description of the invention provided herein.

BRIEF DESCRIPTION OF THE DRAWINGS

The invention is described in more detail in conjunction with a set of accompanying drawings.

FIG. 1 illustrates a vehicle on a track.

FIG. 2 illustrates a mechanical vertical gyroscope of an embodiment of the invention.

FIG. 3 is a block diagram of a mechanical vertical gyroscope sensor circuit.

DETAILED DESCRIPTION OF THE PREFERRED EMBODIMENTS

Figure 4:
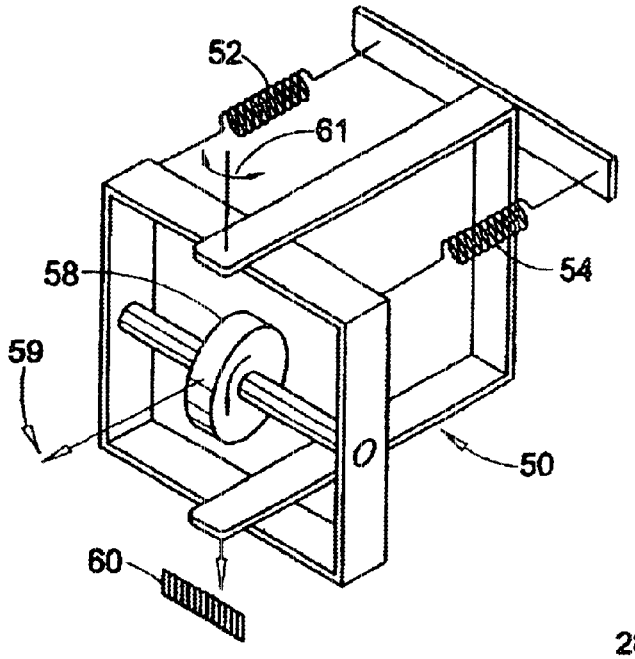
FIG. 4 illustrates a mechanical rate gyroscope of an embodiment of the invention.

While the invention is described in conjunction with the accompanying drawings, the drawings are for purposes of illustrating exemplary embodiments of the invention and are not to be construed as limiting the invention to such embodiments. It is understood that the invention may take form in various components and arrangement of components and in various steps and arrangement of steps beyond those provided in the drawings and associated description. Within the drawings, like reference numerals denote like elements.

With reference to FIG. 1, a track 10 may be defined by a longitudinal axis 12, a roll axis 13, a lateral axis 14, a pitch axis 15, a vertical axis 16, and a yaw axis 17. The roll axis measures roll (i.e., cross elevation, cross-level, or superelevation) of the track about the longitudinal axis. The pitch axis measures pitch (i.e., grade) of the track about the lateral axis. The yaw axis measures yaw (i.e., rate of curvature) of the track about the vertical axis. As shown in FIG. 1, the longitudinal axis 12, roll axis 13, lateral axis 14, pitch axis 15, vertical axis 16, and yaw axis 17 also relate to a vehicle 28 traveling on the track 10. The vehicle 28 may be an autonomous vehicle (e.g., a self-propelled railroad car or a track inspection truck) or associated with multiple vehicles in a train. Where the vehicle 28 is in a train, it may be any vehicle of the train, including locomotives or railroad cars making up the train.

Figure 14:
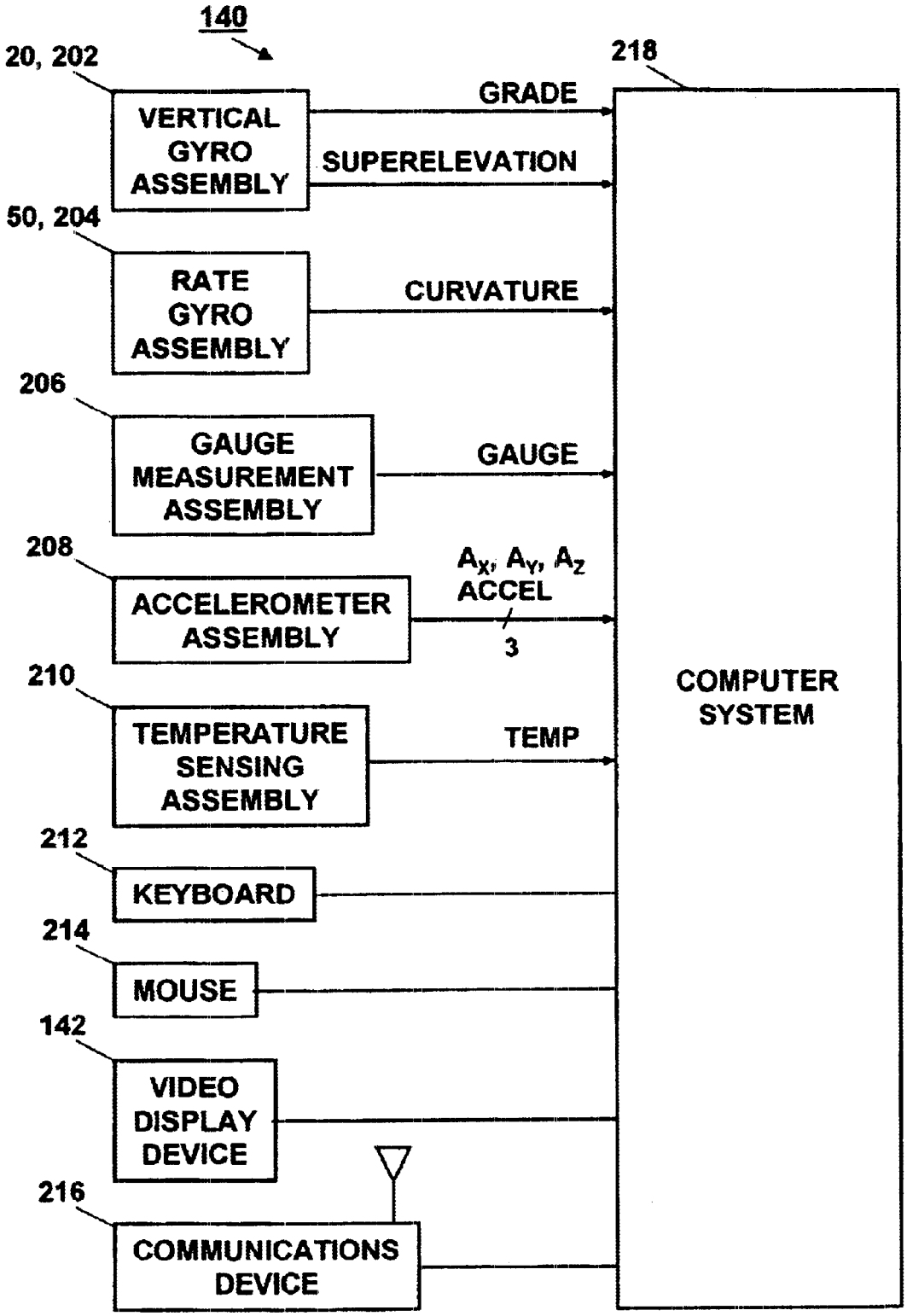
FIG. 14 is a block diagram of a track analyzer in an embodiment of the invention.

With reference to FIG. 14, one embodiment of the invention is a track analyzer 140. The track analyzer is included on a vehicle 28 traveling on a track 10. The track analyzer 140 includes a vertical gyro assembly 20, 202, a rate gyro assembly 50, 204, a non-contact gauge measurement assembly 206, an accelerometer assembly 208, a temperature sensing assembly 210, a keyboard 212, a mouse 214, a video display device 142, a communications device 216, and a computer system 218.

Figure 21:
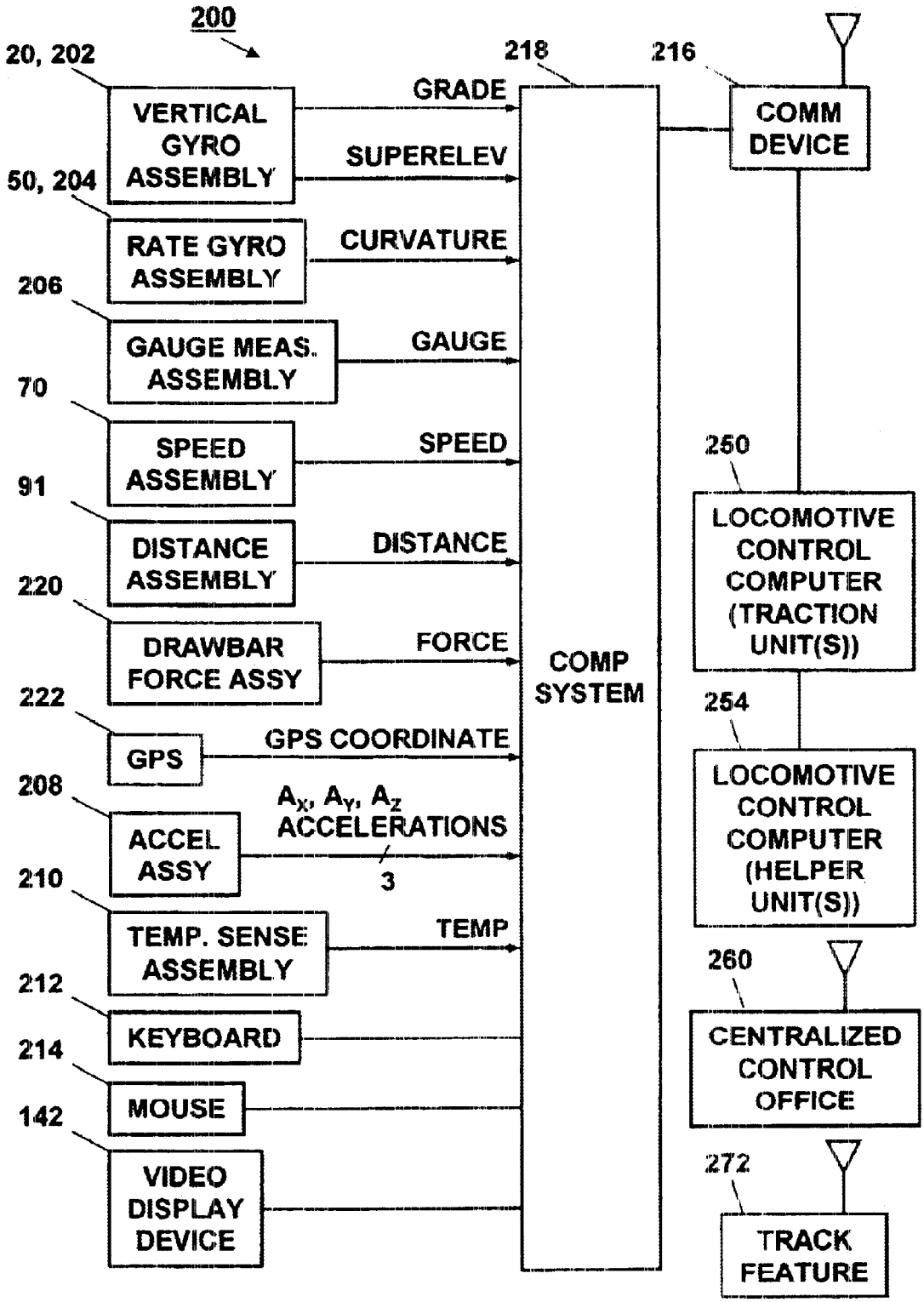
FIG. 21 is a block diagram of a track/vehicle analyzer in an embodiment of the invention.

With reference to FIG. 21, another embodiment of the invention is a track/vehicle analyzer 200. The track/vehicle analyzer is also included on a vehicle 28 traveling on a track 10. The track/vehicle analyzer 200 includes a vertical gyro assembly 20, 202, a rate gyro assembly 50, 204, a gauge measurement assembly 206, a speed assembly 70, a distance measurement assembly 91, a drawbar force assembly 220, a global positioning system 222, an accelerometer assembly 208, a temperature sensing assembly 210, a keyboard 212, a mouse 214, a video display device 142, a communications device 216, and a computer system 218.

Figure 22:
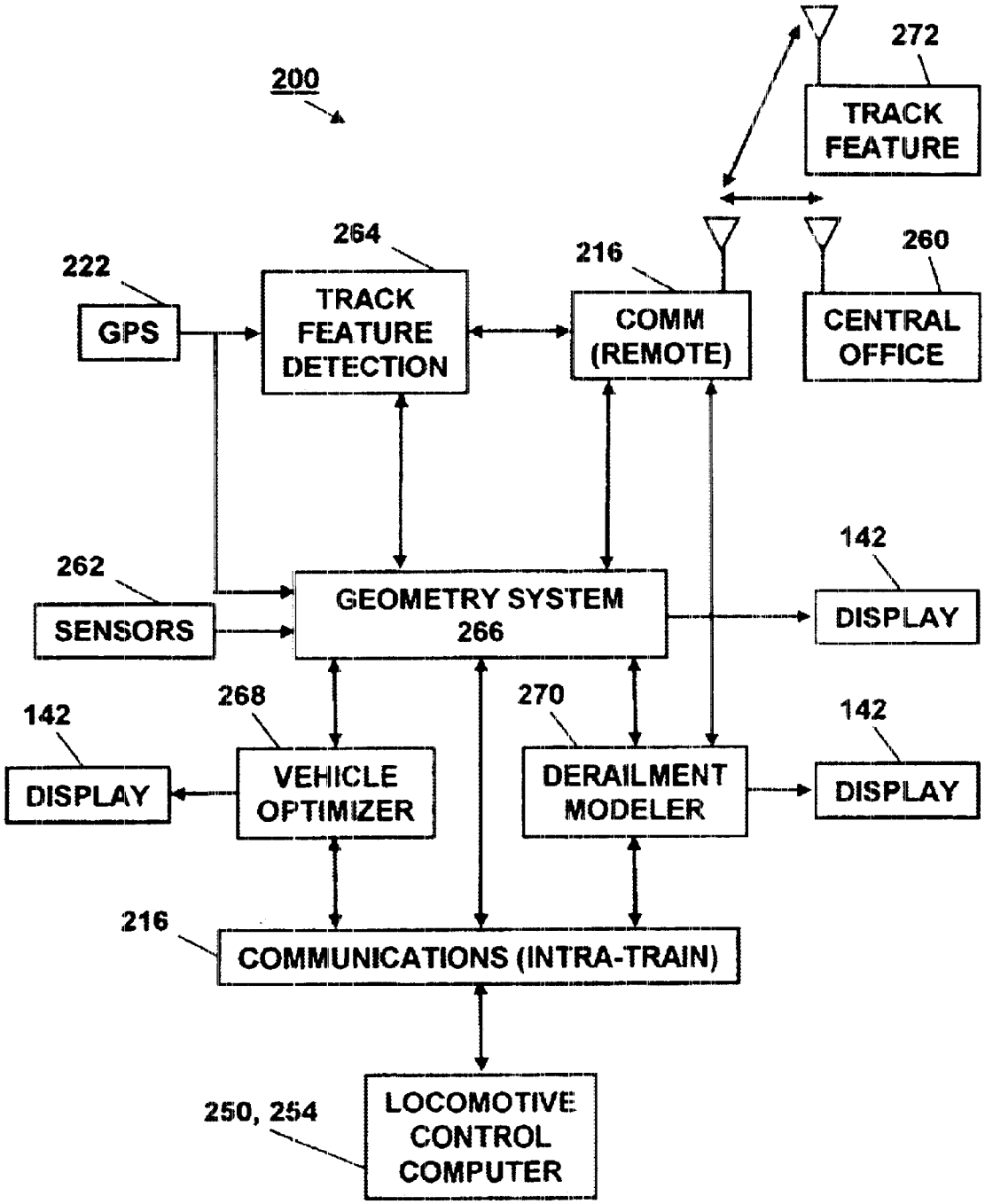
FIG. 22 is an information flow diagram for an embodiment of a track/vehicle analyzer.

With reference to FIG. 22, an information flow diagram for an embodiment of the track/vehicle analyzer 200 is provided. As shown, the track/vehicle analyzer includes a video display device 142, a communications device 216, a global positioning system 222, sensors 262, a track feature detection process 264, a geometry system process 266, a vehicle optimization process 268, and a derailment modeler process 270. A locomotive control computer 250, 254, a centralized control office 260, and a track feature 272 are external components that communicate with the analyzer via the communications device. The locomotive control computer is associated with the vehicle 28 wherein the track/vehicle analyzer is disposed. Therefore, communications between the track/vehicle analyzer and the locomotive control computer are intra-train communications. The centralized control office and track feature are not associated with the vehicle or a train associated with the vehicle. Therefore, communications between the track/vehicle analyzer and the centralized control office or the track feature are remote communications.

The global positioning system 222, sensors 262, locomotive control computer 250, 254, centralized control office 260, and track feature 272 are the potential sources of raw information. The heart of the track/vehicle analyzer 200 is the geometry system process 266, which receives raw information from any of these sources. In addition, the track feature detection process 264 receives raw information from the global positioning system and communicates with the track feature via the communications device 216. The track feature detection process provides processed information to the geometry system process. The geometry system process processes the raw information and processed track feature information to detect hazardous conditions associated with the track 10. If hazardous conditions are detected, the geometry system process communicates corrective actions to a vehicle operator via the video display device 142 and to the locomotive control computer and the centralized control office via the communications device.

The geometry system process 266 also communicates with the vehicle optimizer process 268. The vehicle optimizer process 268 processes raw and processed information in cooperation with the geometry system process to determine an optimized control strategy for the vehicle 28. The optimized control strategy is communicated to the vehicle operator via the video display device 142 and to the locomotive control computer 250, 254 via the communications device 216. Feedback is communicated from the locomotive control computer to the vehicle optimizer process, creating an automated closed-loop control mechanism.

The geometry system process 266 also communicates with the derailment modeler process 270. The derailment modeler process processes raw and processed information in cooperation with the geometry system process to dynamically model each vehicle in a train associated with the vehicle 28 wherein the track/vehicle analyzer 200 is disposed to determine which vehicle has the highest statistical probability for causing a derailment. When a hazardous derailment condition exists, the derailment modeler process also determines a recommended course of action, including an optimized control strategy. The recommended course of action is communicated to the vehicle operator via the video display device 142 and to the locomotive control computer 250, 254 and centralized control office 260 via the communications device 216.

Figure 15:
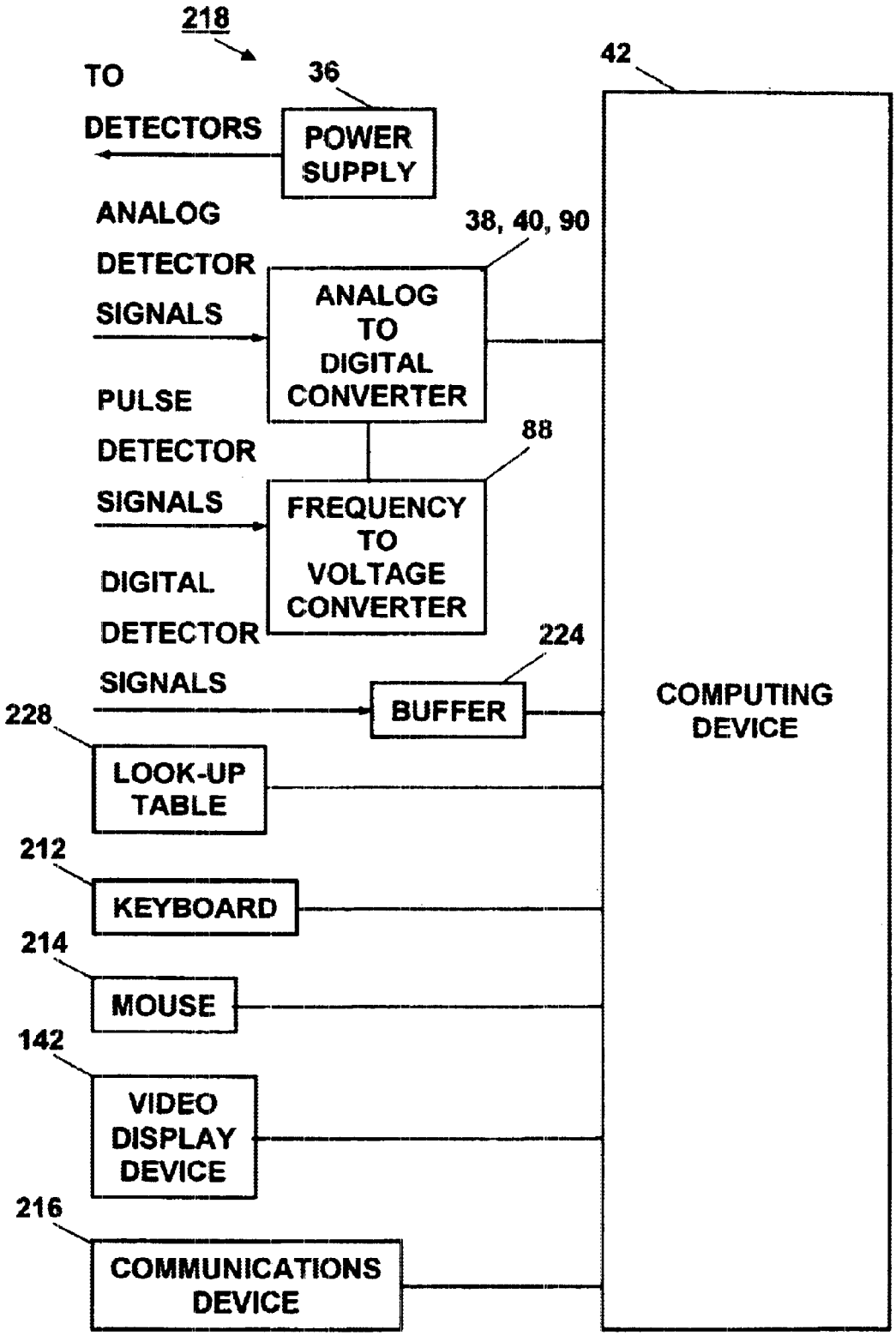
FIG. 15 is a block diagram of a computer system of an embodiment of the invention.
Figure 16:
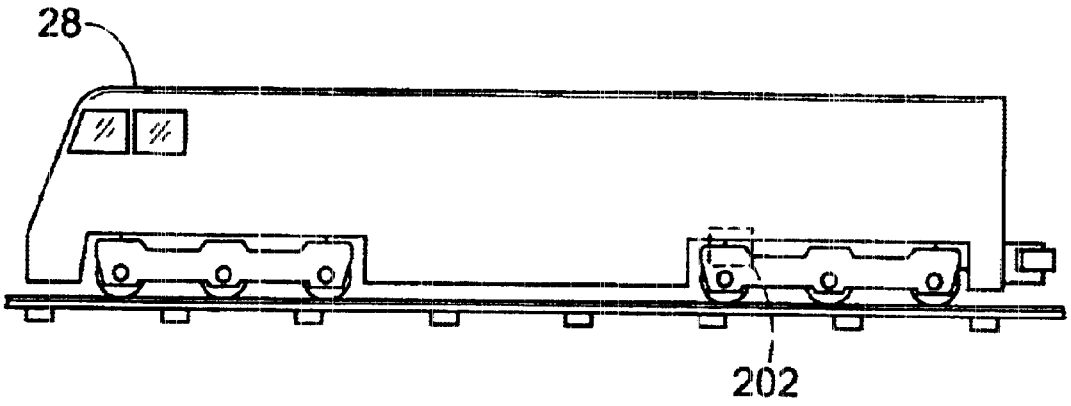
FIG. 16 illustrates a location of an inertial navigation unit of an embodiment of the invention.

With reference to FIG. 15, the computer system 218 includes a power supply 36, one or more analog to digital converters 38, 40, 90, a frequency to voltage converter 88, a buffer 224, a look-up table 226, and a computing device 42. The power supply 36 provides a source of power to various detector assemblies (e.g., 20, 50) of the analyzer 140, 200. As shown in FIGS. 14 and 21, each detector assembly provides one or more raw signals to the computer system 218. These raw signals may be in analog, digital pulses, digital, or other forms and may require various types of signal conditioning and/or buffering in an input stage to the computing device 42. For example, raw analog signals from the detector assemblies are transformed by an analog-to-digital converter 38, 40, 90 into a digital format. Similarly, raw digital pulse signals are conditioned by a frequency-to-voltage converter 88 and further conditioned by an analog-to-digital converter 90. Raw digital signals from the detector assemblies are usually isolated by a buffer 224 and may be scaled prior to being received by the computing device. The computing device 42 and signal conditioning and buffering circuits provide channels for receiving each track parameter (i.e., grade, superelevation, rate of curvature, and gauge) and each vehicle parameter (i.e., speed, distance, drawbar force, global positioning system (GPS) coordinates, acceleration, and temperature) from the detector assemblies.

With reference to FIGS. 1 and 2, a vertical gyroscope 20 ("gyro") includes an inner gimbal 22, which measures the pitch (i.e., grade) 14 and an outer gimbal 24, which measures the roll (i.e., cross elevation, cross-level, or superelevation) 12. Respective bearings 26 secure the inner and outer gimbals 22, 24, respectively, to a vehicle (e.g., railroad car) 28 traveling on the track 10. The vertical gyro 20 includes a spin motor 30, which always remains substantially vertical. The spin motor 30 preferably spins at about 30,000 revolutions per minute ("rpm"). In this manner, the spin motor 30 acts as an inertial reference (e.g., axis). Any motion by the inner gimbal 22 and/or the outer gimbal 24 is measured against the inertial reference of the spin motor 30.

Although a mechanical vertical gyroscope 20 is shown in FIG. 2, it is to be understood that any device, which has a spinning mass with a spin axis that turns between two low-friction supports and maintains an angular orientation with respect to inertial coordinates when not subjected to external torques, is contemplated.

Furthermore, it is to be understood that non-mechanical gyroscopes are also contemplated. For example, a solid state vertical gyroscope 202 that can supply roll axis and pitch axis information and be corrected for outside influences (e.g., external influences of acceleration and temperature on the sensor elements), is contemplated. The solid state vertical gyroscope 202 includes a grade determiner for determining the grade of the track and a superelevation determiner for determining the superelevation of the track and is sometimes referred to as an inertial measurement unit (IMU). The solid state vertical gyroscope (IMU) 202, like the mechanical vertical gyroscope 20, is mounted on the vehicle 28 for measuring roll 12 and pitch 14 (see FIG. 15).

With reference to FIGS. 2 and 3, raw analog electric signals are generated by first and second potentiometers 32, 34, respectively, which are preferably powered by a power supply 36 (e.g., a ±10 VDC power supply). The first and second potentiometers 32, 34 are secured to the outer and inner gimbals 24, 22, respectively. The analog signals are transmitted to respective analog-to-digital converters 38, 40. The analog-to-digital converters 38, 40 transform the analog signals into a digital format. The digital signals are then transmitted to the computing device 42. In this manner first and second channels to the computing device represent the grade and cross-level (i.e., superelevation) of the track, respectively. Similarly, in regard to the rate gyro assembly 50, 204, a third channel to the computing device represents the rate of curvature of the track.

When setting up the system, it is important that the roll axis 12 is substantially parallel to the track 10. Then, by default the pitch axis 14 is substantially perpendicular to the longitudinal axis 12 of the track 10.

With reference to FIG. 4, a rate gyroscope 50 includes first and second springs 52, 54, respectively. The springs 52, 54 give the rate gyro 50 a single degree of freedom around an axis of rotation located above a spin motor 58. A torque axis 59 is in a direction perpendicular to a gimbal axis 61 around which the spin motor 58 turns. A measurement potentiometer 60 detects displacement of the spin motor 58 from a reference line parallel to the torque axis 59. The rate gyroscope 50 is mounted on the vehicle 28 for measuring yaw 16 (see FIG. 1).

More specifically, as long as the vehicle 28 is traveling straight, the forces on the springs 52, 54 are equal. Therefore, the torque axis remains parallel to the direction of travel. When the vehicle 28 travels through a curve, having a radius R, along the track 10 (see FIG. 5), the spin motor 58 and torque axis 59 tend to remain in the same direction as when the vehicle 28 travels straight. In this manner, the rate gyro 50 measures a displacement from a reference line (e.g., a rate-of-change of displacement about the yaw axis). The angle of rotation (displacement) about the gimbal axis 61 corresponds to a measure of the input angular rate (angular velocity).

Although a mechanical rate gyroscope is shown in FIG. 4, it is to be understood that any device, which has a spinning mass with a spin axis that turns between two low-friction supports and maintains an angular orientation with respect to inertial coordinates when not subjected to external torques, is contemplated.

Furthermore, it is to be understood that non-mechanical rate gyroscopes are also contemplated. For example, a fiber optic gyroscope (FOG) 204 that can supply rate axis information is shown in the track/vehicle analyzer 200 of FIG. 20. The fiber optic rate gyroscope 204 is based on the Sagnac interferometer effect as is a laser ring gyroscope. FOGs are typically based on an all-fiber concept using elliptical-core polarization maintaining fiber, directional coupler(s), and a polarizer. Like in the embodiment with the mechanical rate gyroscope, the fiber optic rate gyroscope 204 is mounted on the vehicle 28 for measuring yaw 16 (see FIG. 1).

Figure 13:
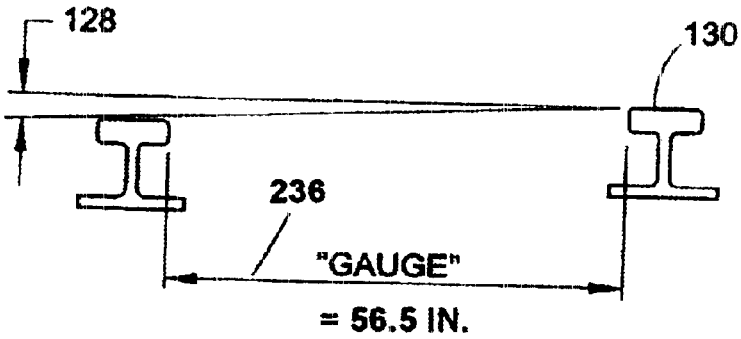
FIG. 13 illustrates a cross-level (i.e., superelevation) measurement and an example definition of gauge measurement for a track.
Figure 17:
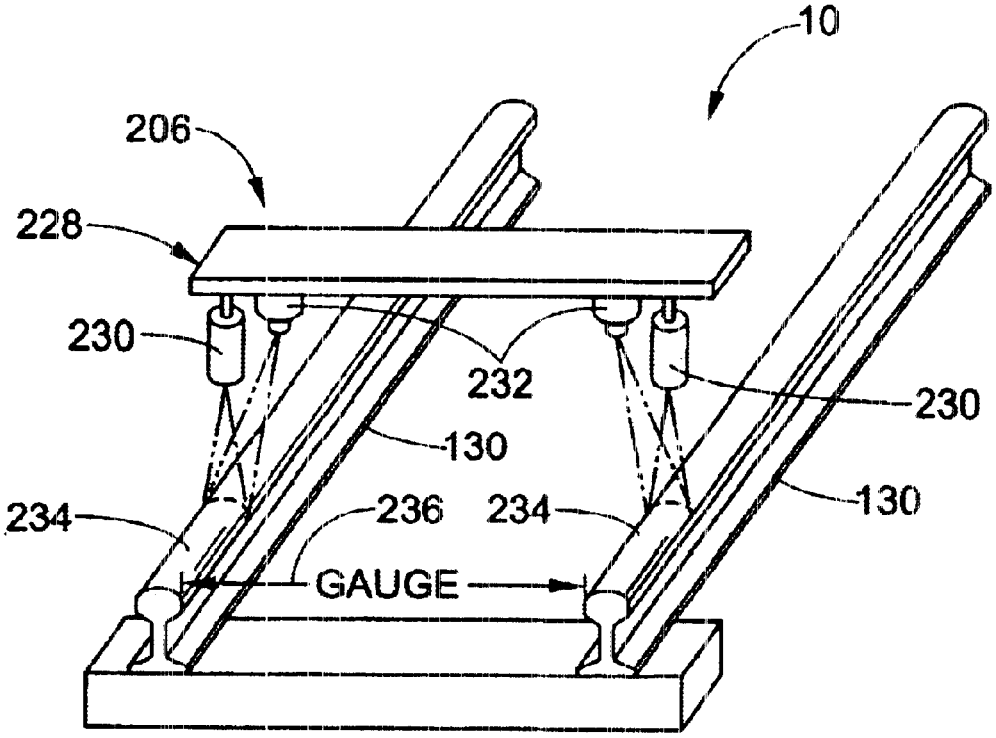
FIG. 17 illustrates a non-contact gauge measurement assembly of an embodiment of the invention.

With reference to FIGS. 13 and 17, the non-contact gauge measurement assembly 208 includes a laser-camera assembly 228 positioned over each rail 130 of the track 10. The laser 230 "paints" a line perpendicular to the longitudinal axis of the rails 130. The camera 232 captures the laser light image reflected from the head 234 of the rail. This occurs for both rails. In the embodiment being described, images from the cameras are transmitted to the computing device 42 for processing. The camera images are processed such that the points ⅝ of an inch from the top 234 of rail (i.e., gauge point) are determined within the image frames. These images are further processed together to yield the distance between the rails 130 (i.e., the "gauge" 236 of the rail). FIG. 13, for example, shows a railroad track where 56.5" is the standard distance between the rails.

Figure 18:
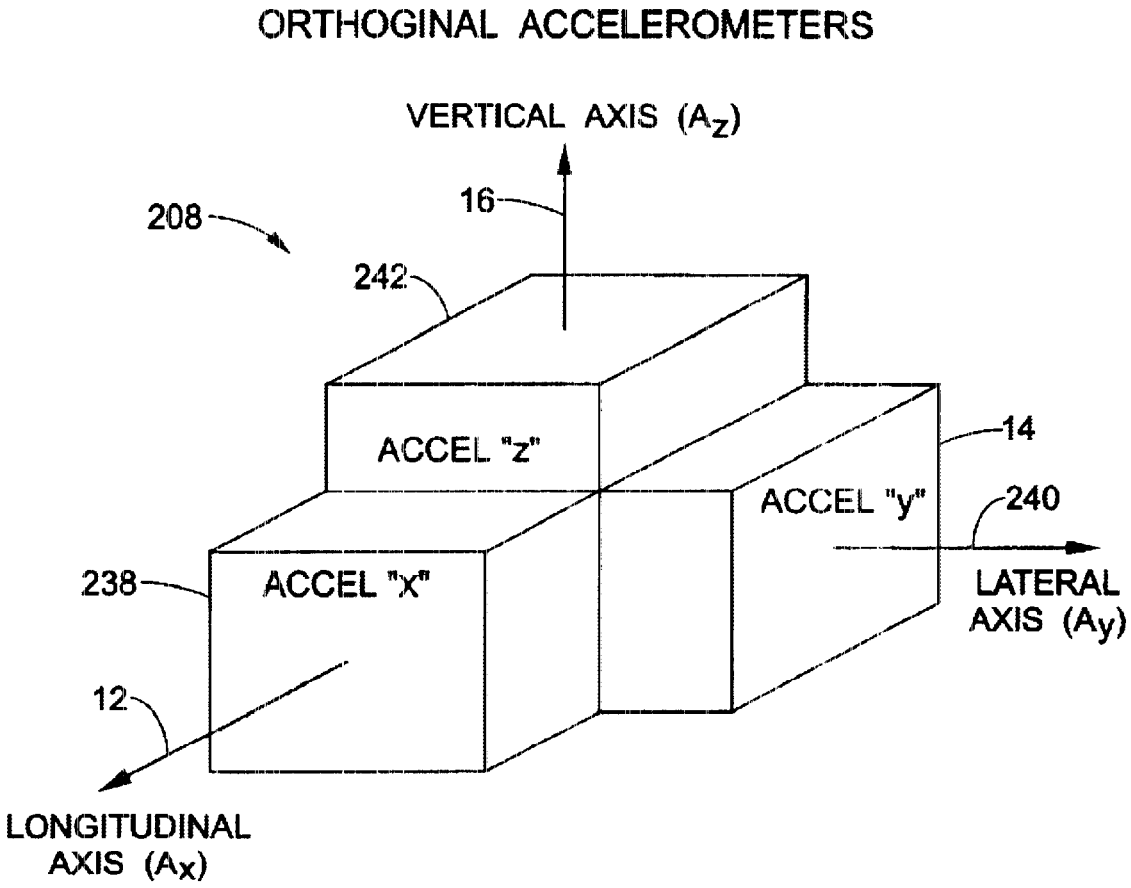
FIG. 18 illustrates an accelerometer assembly of an embodiment of the invention.

With reference to FIG. 18, the accelerometer assembly 208 includes three accelerometers 238, 240, 242 that are mounted at right angles to each other to accurately determine accelerations along the longitudinal axis 12, lateral axis 14, and vertical axis 16 (see FIG. 1). The X accelerometer 238 detects accelerations in the longitudinal axis 12 and provides an $A_X$ signal. The Y accelerometer 240 detects accelerations in the lateral axis 14 and provides an $A_Y$ signal. The Z accelerometer 242 detects accelerations in the vertical axis 16 and provides an $A_Z$ signal. Each accelerometer 238, 240, 242 produces a DC voltage proportional to the acceleration applied to the vehicle in the direction under study. The analog signals are transmitted to respective analog-to-digital converters (e.g., 38), transformed into a digital format, then to the computing device 42 (see FIG. 15).

With reference to FIGS. 14 and 21, the temperature sensing assembly 210 includes one or more temperature probes. One temperature probe is mounted with instruments in the IMU. Other temperature probes are mounted with other temperature sensitive detectors and instruments. Each temperature probe produces an analog signal output that is proportional to the temperature of its environment (e.g., the interior of IMU package). The analog signal is transmitted to an analog-to-digital converter (e.g., 38), which transforms the analog signal into a digital format, then to the computing device 42 (see FIG. 15).

Figure 6:
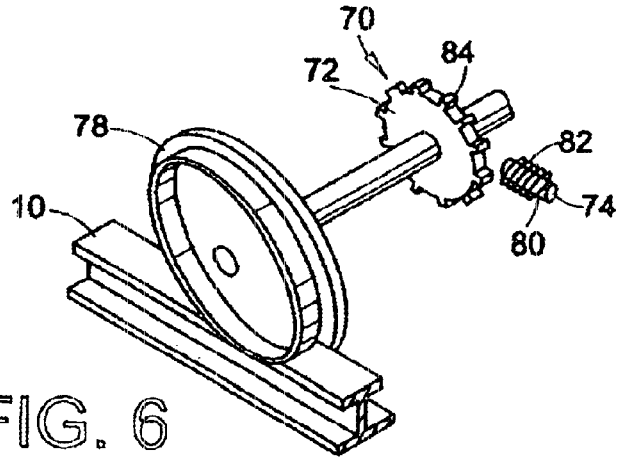
FIG. 6 illustrates a speed assembly of an embodiment of the invention.

With reference to FIG. 6, a speed assembly (e.g., a speedometer) 70 includes a toothed gear 72 and a pick-up (sensor) 74. The speed assembly determines the speed of the vehicle with respect to the track and may also be referred to as a speed determiner. The speed determiner 70 is connected to a rail wheel 78 contacting the track 10.

Figure 7:
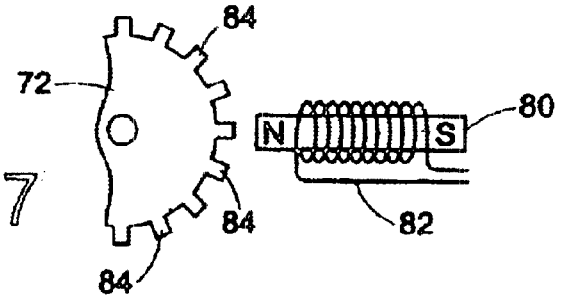
FIG. 7 illustrates a gear and speed sensor of the speed assembly of FIG. 6.
Figure 8:
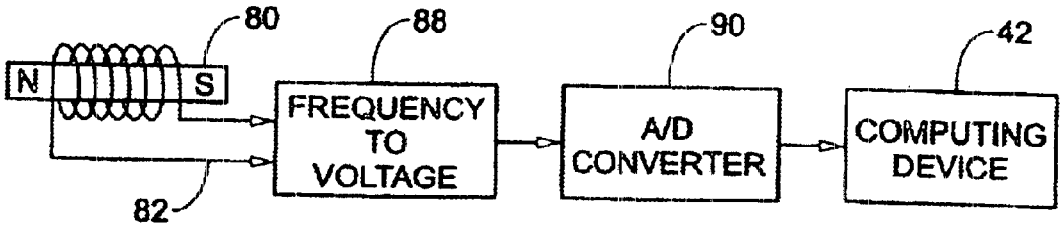
FIG. 8 is a block diagram of a speed sensor circuit.

With reference to FIGS. 6–8, the sensor 74 includes a magnet 80 and a pick-up coil 82, which acts as a sensor. As teeth 84 along the toothed gear 72 pass by the sensor 74, a back electromagnetic force (voltage) is induced into the pick-up coil 82. The frequency of the voltage is proportional to the speed of the vehicle. The variable alternating current ("A.C.") voltage is transmitted, for example, from the magnet 80 and coil 82 to a frequency-to-voltage converter 88 (see FIG. 8). The frequency-to-voltage converter 88 produces a direct current ("D.C.") voltage proportional to the speed of the vehicle 28 traveling on the track 10. The D.C. voltage is transmitted to an analog-to-digital converter 90, which transforms the analog signals into a digital format. The digital signals are then transmitted to the computing device 42 for processing.

Figure 9:
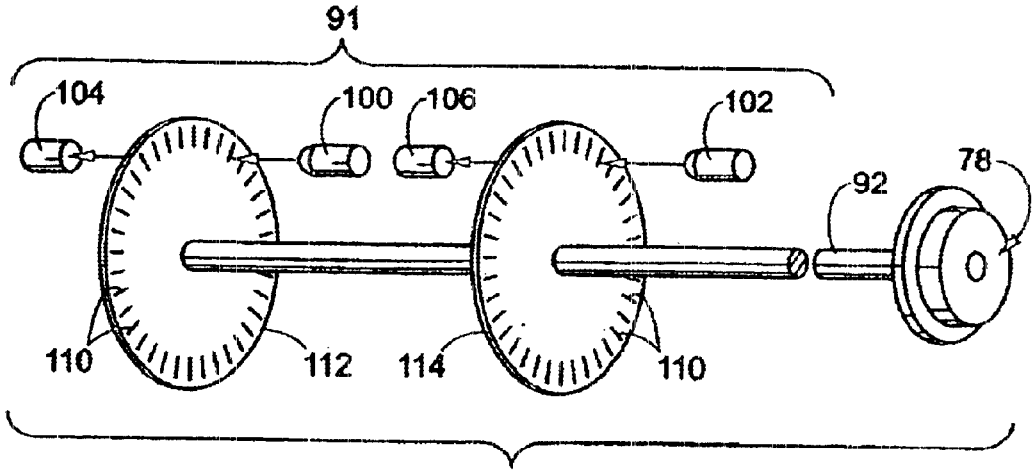
FIG. 9 illustrates a distance measurement assembly of an embodiment of the invention.

With reference to FIG. 9, a distance measurement assembly 91 serves as a distance determiner (e.g., an odometer). The distance measurement assembly 91 includes first and second light sources 100, 102, respectively, and first and second light detectors 104, 106 (e.g., phototransistors), respectively, positioned near slots 110 in first and second plates 112, 114, respectively, along an axis 92 including the wheel 78. The distance determiner of the distance measurement assembly 91 acts to measure relative incremental distance (as opposed to "absolute" distance) that the vehicle 28 travels. The plates 112, 114 are preferably positioned such that a slot 110 in the first plate 112 "leads" a slot 110 in the second plate 114 by some portion of degrees (e.g., about 90 degrees), thereby forming a quadrature encoder. Hence, the distance measurement assembly being described may also be referred to as a quadrature encoder assembly.

Figure 10:
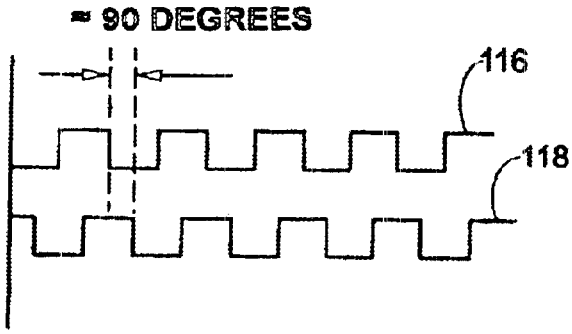
FIG. 10 is a timing diagram for determining direction traveled on a track using the distance measurement assembly of FIG. 9.

With reference to FIGS. 9 and 10, electrical pulses represented by phase A 116 and phase B 118 are received by the detectors 104, 106 when light from the sources 100, 102 passes through the slots 110 in the respective plates 112, 114. The space between each of the slots 110 is known. Furthermore, each of the plates 112, 114 rotates as a function of the distance the vehicle travels. As indicated by the dotted lines in FIG. 10, the pulses 116, 118 are out-of-phase by some portion of degrees (e.g., about 90 degrees). Both phase A 116 and phase B 118 are transmitted from the detectors 104, 106 to the computing device 42, which determines the distance the vehicle 28 has moved as a function of the number of pulses produced by one of the phase. Also, the direction in which the vehicle 28 is moving is determined by whether the phase A 116 of the first plate 112 leads or lags phase B 118 of the second plate 114.

The distance is preferably determined in one of two ways. The distance determiner of the distance measurement assembly 91 requires the vehicle 28 to start at, and proceed from, a known location. For example, the vehicle 28 may proceed between two (2) "mile-posts." Alternatively, a differentially corrected global positioning system ("DGPS") 222 may be used to avoid manually identifying location information. This alternative is necessary where manual intervention is not available. More specifically, the position of the vehicle 28 is obtained from the GPS 222. Then, the distance determiner of the distance measurement assembly 91 is used to update the position of the vehicle 28 between the GPS transmissions (e.g., if the vehicle is in a tunnel).

With reference to FIGS. 8, 9, and 10, the speed may also be determined from either phase 116 or 118 of the distance measurement assembly 91. The electrical pulse 116, 118 from each detector 104, 106 provides a pulsed signal with a frequency of the pulse proportional to the vehicle speed. Accordingly, the distance measurement assembly 91 may be used in place of the speed determiner 70 of FIG. 6. For example, the phase A 116 may be fed to the frequency-to-voltage converter 88 from detector 104 with the circuit of FIG. 6 operating in the same manner as described above. Either method of determining speed in combination with train control speed information will yield a true vehicle speed (i.e., true "ground speed") with respect to the rail bed.

Figure 19:
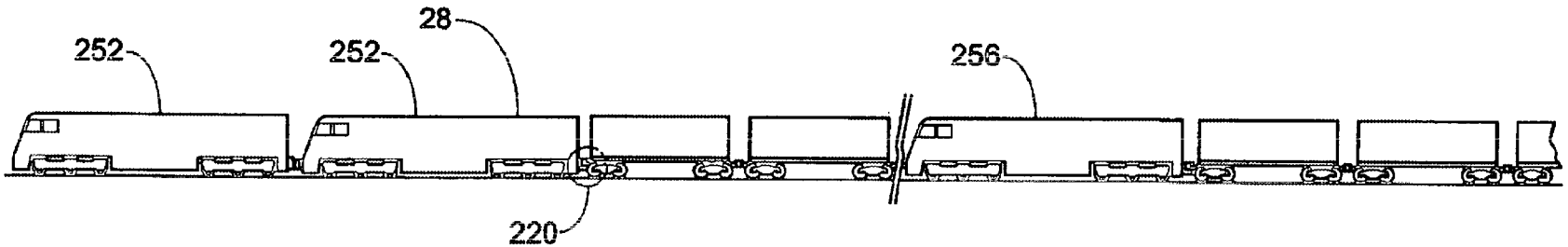
FIG. 19 illustrates a location of a drawbar force assembly of an embodiment of the invention.
Figure 20:
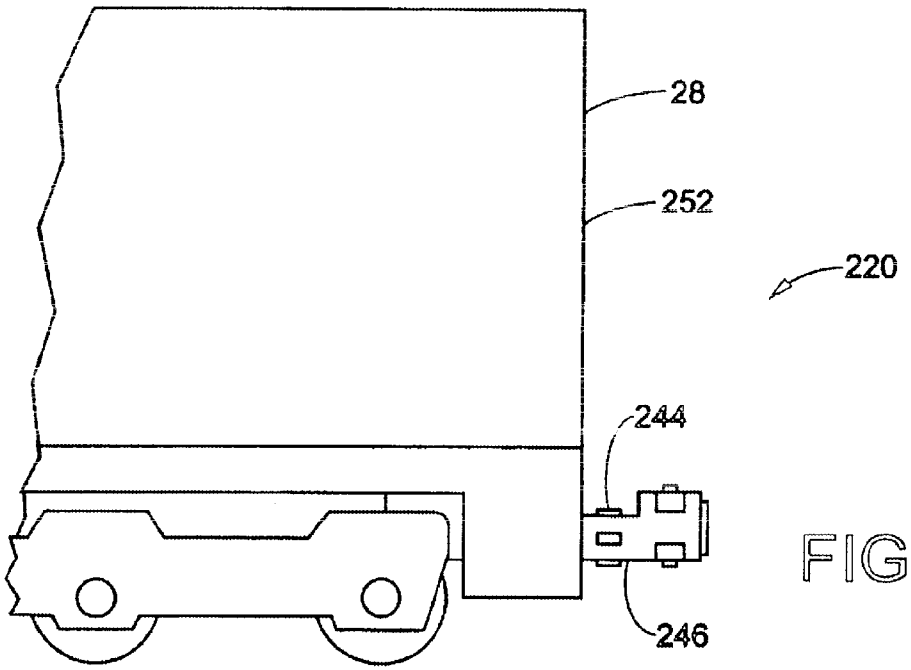
FIG. 20 illustrates the drawbar force assembly of an embodiment of the invention.

With reference to FIGS. 19 and 20, the drawbar force assembly 220 includes strain gauges 244 mounted on a drawbar 246 of the vehicle 28 (e.g., a lead unit 252). These strain gauges are mounted such that the voltage output is an analog signal proportional to longitudinal tension of the train on the drawbar. The analog signal is transmitted to the respective analog-to-digital converter (e.g., 38), which transforms the analog signal into a digital format, then to the computing device 42 (see FIG. 15). The longitudinal tension is processed as a feed-forward into the locomotive train control model.

Referring to FIGS. 14 and 21, the communications device 216 may utilize any suitable communications technology to communicate with locomotive control computers 250 in lead units 252 associated with the vehicle 28 and a centralized control office 260. While typically the lead units 252 communicate with locomotive control computers 254 in helper units 256 operating in the middle of the train, the communications device may also utilize any suitable communications technology to communicate locomotive control computers 254 in helper units 256. For example, the communications device 216 may utilize cable connections and a standard electrical communications protocol (i.e., Ethernet) to communicate, for example, with locomotive control computers in the lead units 252. Additionally, the communications device 216 may utilize wireless communications (e.g., radio frequency (RF), infrared (IR), etc.) to communicate, for example, with locomotive control computers in the lead units 252 or helper units 256. The communications device 216 may utilize other wireless communications (e.g., cellular telephone, satellite communications, RF, etc.) to communicate, for example, with the centralized control office.

For example, a cellular modem is optionally used in the vehicle 28 to automatically update a data bank of known track defects at the centralized control office. More specifically, as the vehicle travels on the track in a geographic area (e.g., North America), the analyzer 140, 200 collects and analyzes information. When a track defect is detected, the information is transmitted (uploaded) to a main computer at the centralized control office via the cellular modem. The cellular modem is also optionally used in the analyzer 140, 200 to collect or receive train manifest information. The train manifest information includes the sequence of locomotives and railroad cars and physical characteristics about each vehicle in the train. This information is stored in a look-up table 226 and used by software applications in the computing device 42 (e.g., dynamic modeling software).

Additionally, the communications device (e.g., cellular modem) is optionally used in the analyzer 140, 200 to communicate with upcoming track features such as switches and crossings. In combination with a GPS 222, the computing device 42 knows the current position of the vehicle 28. Therefore, the computing device 42 also knows of upcoming track features. The analyzer 140, 200 may, for example, communicate with a switch to verify that the switch is currently aligned for travel by the vehicle or associated train. The analyzer 140, 200 could also communicate with an upcoming "intelligent" crossing to determine whether or not there is an obstacle on the track.

Figure 5:
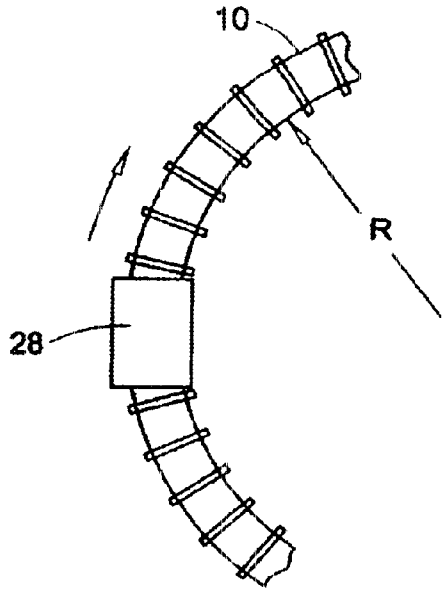
FIG. 5 illustrates a vehicle traveling on a section of curved track.
Figure 11:
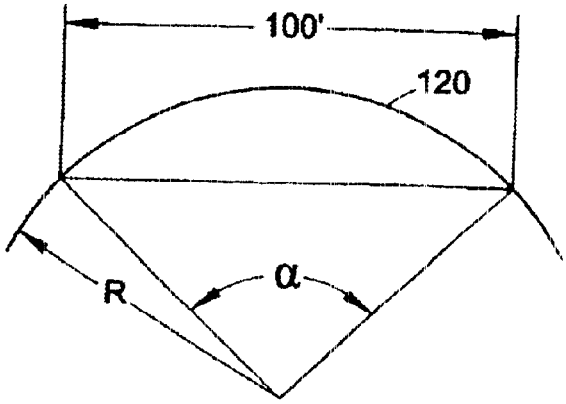
FIG. 11 illustrates the definition of "degree of curve."

With reference to FIGS. 5 and 11, a degree-of-curve is defined as an angle $\alpha$ subtended by a chord 120 (e.g., 100 foot). The distance determiner discussed above is used in the calculation of the chord 120 distance. Also, the rate gyro and speed determiner discussed above are used to determine the degree-of-curve. More specifically, the rate gyro 50, 204

(see FIG. 4) and the speed determiner 70, 91 (see FIGS. 6 and 9) may determine a certain rate in degrees/foot. That rate is then multiplied by the length of the chord 120 (e.g., 100 feet), which results in the degree-of-curve. The degree-of-curve represents a "severity" of a particular curve in the track 10.

Figure 12:
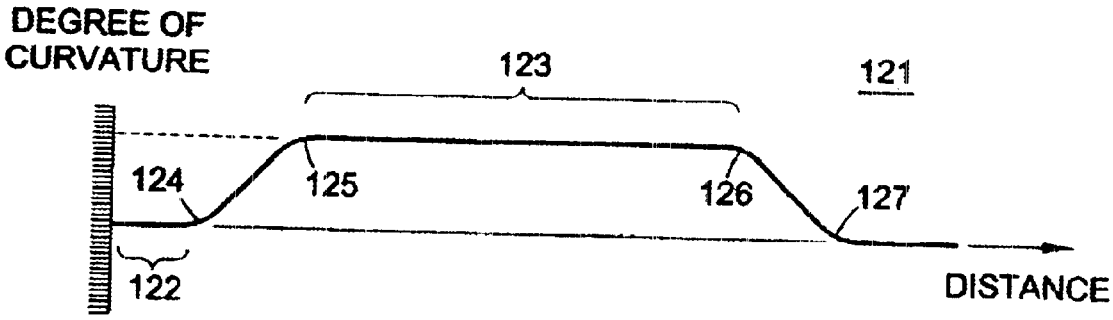
FIG. 12 is a graph of "degree of curvature" versus distance.

FIG. 12 represents a graph 121 of degree-of-curvature versus distance. As a vehicle enters/exits a curve in a track (see, for example, FIG. 5), the degree-of-curvature changes. While the vehicle is on straight track (e.g., a tangent) or in the body of a curve having a constant radius, the degree-of-curvature remains constant 122, 123, respectively. A point 124 represents a beginning of an entry spiral; a point 125 represents an end of the entry spiral/beginning of a body of curve; a point 126 represents an end of the body of curve/beginning of an exit spiral; and a point 127 represents an end of the exit spiral. The entry and exit spirals represent transition points between straight track and the body of a curve, respectively. Determining whether the vehicle is on a straight track (tangent), a spiral, or a curve is important for determining what calculations will be performed below.

Data representing engineering standards for taking corrective actions may be pre-loaded into a look-up table 226 (e.g., a storage or memory device) included in the computer system 218. The following corrective actions, for example, may be identified:

1) Safety Tolerances that, when exceeded, identify Urgent defects (UD1) that must be attended to substantially immediately;
2) Maintenance Tolerances that, when exceeded, identify Priority defects (PD1) that may be attended to at a later maintenance servicing;
3) Curve Elevation Tolerances (CET) that, when exceeded, identify potentially unsafe curve elevations; and
4) Maximum Allowance Runoff (MAR) Tolerances that, when exceeded, identify potentially unsafe uniform rise/falls in both rails over a given distance.

The defects discussed above are typically classified into at least two (2) categories (e.g., Priority or Urgent). Priority defects identify when corrective actions may be implemented on a planned basis (e.g., during a scheduled maintenance servicing or within a predetermined response window). Urgent defects identify when corrective actions must be taken substantially immediately. The classification of defects will also yield actions to be taken to influence the control and operations of the vehicle or associated train. The classifications of defects and identification of control actions are performed in real-time.

It is to be understood that it is also contemplated to store other parameters relating to the vehicle and/or track in the look-up table 226 in alternate embodiments.

As discussed above, tangents are identified as straight track. Curves correspond to a body of a curve, i.e., the constant radius portion of a curve. Warp-in-tangents and curves (i.e., Warp 62) are calculated as a maximum difference in cross-level (i.e., superelevation) anywhere along a "window" of track (e.g., 62' of track) while in a tangent section or a curve section. This calculation is made as the vehicle moves along the track. This calculated parameter is then compared to the data (e.g., engineering tables) discussed above, which is preferably stored in the look-up tables. A determination is made as to whether the current section of the track is within specification. If the section of track is identified as not being within specification, a message is produced and the offending data is noted in an exception file, appears on a readout screen of the video display device 142, and is passed along to the train control computers 250, 254 and the centralized control office 260 via the communications device 216.

Warp in spirals (i.e., Warp 31) are calculated as a difference in cross-level (i.e., superelevation) between any two points along a length of track (e.g., 31' of track) in a spiral. The data is also calculated as the car moves along the track. This calculated parameter is compared to the data stored in the look-up tables for determining whether the section of track under inspection is within specification. If the section of track is identified as not being within specification, a message is produced and the offending data is noted in the exception file, appears on a readout screen of the video display device 142, and is passed along to the train control computers 250, 254 and the centralized control office 260 via the communications device 216.

A calculation is also made for determining cross-level (i.e., superelevation) alignment from design parameters at a particular speed. More specifically, this calculation determines a deviation from a specified design alignment. If an alignment deviation is found, it is noted in the exception file and the system calculates a new recommended speed, which would put the track back within design specifications.

A rate of runoff in spirals calculation, which determines a change in grade or rate of runoff associated with the entry and exit spirals of curves, is also performed. The rate of runoff in spirals calculation is performed over a running section of track (e.g., 10') and is compared to design data at a given speed for that section of track. If the rate of runoff is found to exceed design specifications, the fault is noted in the exception file, and a new, slower speed is calculated for the given condition.

Also, a frost heave or hole detector is optionally calculated. The frost heave or hole detector looks for holes (e.g., dips) and/or humps in the track. The holes and humps are longer wavelength features associated with frost heave conditions and/or sinking ballasts.

The analyzer 140, 200 also performs a calculation for detecting a harmonic roll. Harmonic rolls cause a rail car to oscillate side to side. A harmonic roll, known as rock-and-roll, can be associated with the replacement of a jointed rail with continuously welded rails ("CWR") for a ballast which previously had a jointed rail. The ballast retains a "memory" of where the joints had been and, therefore, has a tendency to sink at that location. This calculation for detecting harmonic rolls identifies periodic side oscillations associated in a particular section of track.

All the raw data described above is logged to a file. All spirals and curves are logged to a separate file. All out-of-specification particulars are logged to a separate file. All system operations or exceptions are also logged to a separate date file. All the raw data described above is detected in real-time as the vehicle 28 travels on the track 10. The analysis of parameters based on the raw data with respect to acceptable tolerances stored in the look-up table 226 is also performed in real-time.

"Real-time" refers to a computer system that updates information at substantially the same rate as it receives data, enabling it to direct or control a process such as vehicle control. "Real-time" also refers to a type of system where system correctness depends not only on outputs, but the timeliness of those outputs. Failure to meet one or more deadlines can result in system failure. "Hard real-time service" refers to performance guarantees in a real-time system in which missing even one deadline results in system failure. "Soft real-time service" refers to performance guarantees in a real-time system in which failure to meet deadlines results in performance degradation but not necessarily system failure.

The analyzers 140, 200 of the invention detect track and vehicle parameters in real-time and determine if the parameters are within acceptable tolerances in real-time. The analyzers 140, 200 may also provide information to the video display device 142 in real-time indicating the results of such analyses and recommended actions. Likewise, the analyzers 140, 200 may also provide information to the locomotive control computers 250, 254 indicating the analysis results and recommended actions in real-time. Thus, the information may be available in real-time to operators (e.g., engineers) within view of the video display device 142 and for further processing by the locomotive control computers 250, 254. Such real-time performance by the analyzers 140, 200 is within one second of when the appropriate track and vehicle characteristics are presented to the associated detectors. From a performance view, "hard real-time service" is preferred, but "soft real-time service" is acceptable. Therefore, "soft real-time service" is preferred where cost constraints prevail, otherwise "hard real-time service" is preferred.

All of the data is preferably available for substantially real-time viewing (see video display device (e.g., computer monitor) 142 in FIGS. 14 and 21) in the vehicle 28. Depending on the real-time performance, dimensions/resolution of the display, and screen design, the substantially real-time information appearing on the monitor typically reflects track/vehicle conditions between approximately 100' and approximately 6,000' behind the vehicle when the vehicle is traveling at approximately 65 MPH.

FIG. 13 illustrates a cross-level (i.e., superelevation) 128 for a track 10. Cross-level for tangent (straight) track is typically about zero (0). Allowable deviations of the cross-level are obtained from the data describing Safety Tolerances in the look-up table 226.

The variations in the cross-level (i.e., superelevation) are related to speed. The designation is the "legal speed" for a section of track. This designation is defined in another set of tables, which relate speed to actual track position (mileage). Therefore, the system is able to determine the distance (mileage) and, therefore, looks-up the legal track speed for that specific point of track. The system is able to determine whether the vehicle is on tangent (straight) track, curved track, or spiral track as in the graph shown in FIG. 12. An example of calculations for tangent (straight) track is discussed below.

To determine whether the vehicle is on tangent (straight) track, curved track, or spiral track, the system takes a snap-shot of all the parameters at one foot intervals, as triggered by the distance determiner. Therefore, the system performs such calculations every foot. The data are then statistically manipulated to improve the signal-to-noise ratio and eliminate signal aberrations caused by physical bumping or mechanical "noise." Furthermore, the data are optionally converted to engineering units.

More specifically, at a given time (or distance), if the vehicle is on a tangent (straight) track and traveling 40 mph with an actual cross elevation (i.e., superelevation) of 1⅛", the system first determines an allowable deviation, as a function of the speed at which the vehicle is moving, from the look-up table including data for Urgent defects (UDI). For example, the allowable deviation may be 1½" at 40 mph. Since the actual cross elevation is 1⅛" and, therefore, less than 1½", the cross elevation is deemed to be within limits.

The system then looks-up a 1⅛" cross elevation (i.e., superelevation) in the Priority defects table (PD1) as a function of the speed of the vehicle (e.g., 40 mph) and determines, for example, that an acceptable tolerance of 1" for cross elevation exists at 40 mph. Because the actual cross elevation (e.g., 1⅛") is greater than the tolerance (e.g., 1"), the system records a Priority defect for cross elevation from design.

If, on the other hand, the actual cross elevation (i.e., superelevation) is 1⅝", the system would first look-up the Urgent defects table (UD1) at 40 mph to find, for example, that the allowable deviation is 1½". In this case, since the actual cross elevation is greater than the allowable cross elevation, the system would record an "Urgent defect" of cross elevation from design. Because the priority standards are more relaxed than the urgent standards, the system would not proceed to the step of looking-up a Priority defect.

Since an Urgent defect was discovered, the system would then scan the Urgent defects look-up table UD1 until a cross-level (i.e., superelevation) deviation greater than the current cross elevation (i.e., superelevation) is found. For example, the system may find that a speed of 30 mph would cause the Urgent defect to be eliminated. Therefore, the system may issue a "slow order to 30 mph" to alert the operator of the vehicle to slow the vehicle down to 30 mph (from 40 mph, which may be the legal speed) to eliminate the Urgent defect. If the deviation of the actual cross elevation from the tolerance is great (e.g., greater than 2½"), the a repair immediately condition will be identified.

From the rate gyro-speed determiner condition, the computing device determines when the vehicle is in a body of a curve. Therefore, when the vehicle is in the body of a curve, the system looks up the curve elevation for the legal speed from the curve elevation table. The system then looks up the allowable deviation from the Urgent defects look-up table UD1 and determines the current cross elevation (i.e., superelevation) is less than or equal to: design cross elevation ± allowable deviation for the cross elevation. If that condition is satisfied, the computing device determines that curve elevation is within tolerance. If that condition is not satisfied, the allowable deviation table is searched to find a vehicle speed that will bring the curve elevation table into tolerance. If such a value cannot be found, a repair immediately (e.g., Urgent defect) condition is identified.

The track/vehicle analyzer 200 also utilizes the current cross-level (i.e., superelevation) and curvature to determine a "balanced" speed (as described in the Background above) for the vehicle 28. The "balanced" speed is also known as the "equivalent" speed. This is the ideal speed of travel around a curve, given the current curvature and cross-level of the curve in question.

The analyzer 140, 200 described above are used as a real-time track inspection device. The analyzers may be utilized by track inspectors as part of his/her regular track inspection such that the analyzer points out any track geometry abnormalities and recommends a course of action (e.g., immediately repair the track or slow down the vehicles and trains on a specific section of the track). The analyzer accomplishes this task by comparing physical parameters of the track with the original design parameters combined with the allowed variances for that particular speed. These parameters are stored in design look-up tables 226 (e.g., storage or memory devices) within the computer system 218. If the analyzer identifies a particular section of track that is out of specification, the analyzer identifies a speed that the car may safely travel on that track section.

The device disclosed in the present invention may be mounted in a lead unit 252. As the lead unit travels along the track, the analyzer 140, 200 takes continuous readings. For example, the analyzer measures the rail parameters, collects position information of the lead unit (i.e., vehicle) on the track, determines out-of-specification rails of the track, and/or stores the particulars of that track defect in a storage or memory device, preferably included within the computer system. The analyzer then optionally communicates the information to the centralized control office 260 via the communication device 216. More specifically, for example, the communication device detects an active cellular area, automatically places a cellular telephone call, and dumps (downloads) the track defect data into a central computer at the centralized control office.

The analyzer 140, 200 also notifies a vehicle operator (e.g., train engineer) that the vehicle has passed over an out-of-specification track via the video display device 142. Furthermore, the analyzer notifies the engineer to slow down the train to remain within safety limits and/or to take other corrective measures as seen fit to resolve the problem.

In an alternate embodiment, it is contemplated to implement the device as a "Black Box" to record track conditions. Then, in the event of a derailment, the data could be used to identify the cause of the derailment. In this embodiment, the system would start, run, and shut-down with minimal human intervention.

The analyzer 140, 200 preferably includes an instrument box and a computer system 218. The instrument box is preferably mounted to a frame that accurately represents physical track characteristics. In this manner, the instrument box is subjected to an accurate representation of track movement. In one embodiment, the frame is a lead unit (i.e., locomotive). However, it is also contemplated that the frame be a railroad car or a track inspection truck.

The instrument box senses (picks-up) the geometry information and converts it so that it is suitable for processing by the computing device 42. The track inspection vehicle is also equipped with both a speed determiner and a distance determiner. In the track inspection vehicle configuration, the computing device is mounted in a convenient place. The driver of the vehicle is easily able to view the video display device 142 (e.g., computer monitor) when optionally notified by a "beeping" noise or, alternatively, a voice generated by the computing device. The instrument box can be mounted to the frame assembly of a lead unit. If so, the computer system 218 is placed in a clean, convenient location.

The instrument box preferably includes the vertical gyro assembly 20, 202 described above. The vertical gyro assembly is used for both cross-level (i.e., superelevation) and grade measurements. The instrument box also includes a rate gyro assembly 50, 204, which, as described above, is used for detecting spirals and curves. The instrument box also includes an accelerometer assembly 208 with a set of orthogonal accelerometers. The instrument box also includes a temperature sensing assembly 210. A precision reference power supply and signal conditioning equipment are also preferably included in the instrument box.

Also, the computer system 218 preferably includes a data acquisition board, quadrature encoder board, computing device 42, gyroscope power supplies, signal conditioning power supplies, and/or signal conditioning electronics. If the frame is an autonomous locomotive, additional equipment for a digital GPS system 222 and a communications device 216 are also included.

FIG. 14 illustrates the track analyzer 140 for analyzing the track according to one embodiment of the invention. The track analyzer 140 includes the computer system 218, for receiving, storing, and processing data for inspecting rail track. The computer system 218 communicates with the vertical gyro assembly 20, 202 for receiving grade and cross information. The rate gyro assembly 50, 204 supplies the computer system 218 with rate information. The speed assembly 70 supplies the computer system 218 with vehicle speed. The mileage determiner (odometer) of the distance measurement assembly 91 supplies the computer system 218 with mileage data. The non-contact gauge measurement assembly 206 supplies the computer system 218 with the current gauge of the track (i.e., width between the rails at a point ⅝ of an inch below the head 234 of the rail 130) The orthogonal accelerometers 238, 240, 242 supply the computer system 218 with the current, instantaneous acceleration in three directions. The temperature sensing assembly 210 supplies the computing device with the current temperature of the system components such that corrections to the raw data may be initiated to correct for any temperature dependant drift. The computer system 218 processes the data received from the various components to determine the various conditions of the track discussed above. A video display device 142 displays the messages regarding the out of tolerance defects.

With reference to FIGS. 1, 14, and 21, it is to be understood that the analyzer 140, 200 is mounted within the vehicle 28.

In one aspect, the analyzers 140, 200 improve the operational safety and overall efficiency, including fuel efficiency, vehicle wheel wear, and track wear, for a track and an individual vehicle or a train traveling on the track through communications with locomotive control computers 254 in a lead unit (i.e., locomotive) 252 associated with the vehicle 28. The analyzer determines a plurality of track and vehicle parameters as described above. In addition, the analyzer further calculates the balance speed for the current track geometry and compares the current vehicle speed to the calculated balance speed to determine if the current vehicle speed is within acceptable tolerances of the balance speed. The current technology in locomotive traction control is based on an average North American curve of approximately 2.5 degrees. If real-time rail geometry data, including current curvature and cross-level (i.e., superelevation), can be provided, then the drive system can be optimized for current track conditions, resulting in maximum efficiency. The relationship between the tractive force that drives the locomotive, or other type of vehicle, forward on a rail is expressed by the following equation:

$$F_{Traction}=F_{Normal}*u$$

where u is the coefficient of static friction and $F_{Normal}$ is the normal force at the rail/wheel interface.

Balance speed is the optimum speed of the vehicle at which the resultant force vector is normal to the rail. By maintaining a vehicle at its balanced speed point, $F_{Normal}$ is maximized. Accordingly, $F_{Traction}$ is also maximized when the vehicle is operated at its balanced speed. Furthermore, by maintaining the drive wheels at the highest point of static friction while operating at the balanced speed, the maximum amount of available tractive force ($F_{Traction}$) is achieved. A small change in the velocity (V) through a curve results in significant changes in the lateral (centripetal) forces, as shown in the following equation:

$$F_{Lateral}=\text{Mass}*A_{lateral},$$

where $$A_{lateral}=(1/R_{curve})*V^2$$

Geometrical information about the rail and vehicle is necessary to compute the vectorial sum of the lateral force and the gravitational force in order to ultimately compute the balance speed for the most efficient operation of the vehicle, train, and track. Lateral contact forces between a rail wheel flange of the vehicle and the rail on which the vehicle is traveling gives rise to frictional forces that decelerate the vehicle and reduce the efficiency of the drive system. To overcome these frictional forces requires additional energy beyond the traction forces that are required to drive the rail vehicle forward at the lowest possible energy. The traction force, which is normal to the rail/wheel interface is enhanced by the locomotive drive wheels being spun at a rotational velocity slightly higher than the forward velocity requires. If the current vehicle speed is not within acceptable tolerances of the balance speed, the analyzer provides the necessary track information (e.g., track, vehicle, and balance speed parameters) and an optimized control strategy to the locomotive control computer 250. The optimized control strategy maximizes fuel efficiency and safety and minimizes premature rail wear and premature vehicle wheel wear.

The locomotive control computer 250 takes in the data from the track analyzer and computes the required alterations to the current control strategy toward the end of improving safety and efficiency. The locomotive control computer can then provide engine performance parameters and further information regarding its fuel consumption back to the track analyzer as feed back. The track analyzer compares the engine performance parameters and additional feedback to the track, vehicle, and balance speed parameters and the optimized control strategy and attempts to further optimize the control strategy. This feedback control mechanism can be implemented in various degrees of complexity (e.g., iterated multiple times or continuously).

In another aspect, the analyzers 140, 200 can improve the operational safety and overall efficiency, including fuel efficiency, vehicle wheel wear, and track wear, for a track and a train traveling on the track through communications with locomotive control computers 254 in helper units 256 of train. The analyzer determines a plurality of track and vehicle parameters (e.g., forces on a drawbar of the vehicle) as described above. The track analyzer provides the necessary track information (i.e., track and vehicle parameters) to the locomotive control computers 254 of other vehicles (e.g., helper units 256) such that overall train performance is enhanced. For example, forces on the drawbar of the vehicle are optimized. This is accomplished with drawbar force information from the drawbar force assembly 220, along with other geometry information from other detectors and instruments.

In still another aspect, the analyzers 140, 200 can improve the operational safety for a track and autonomous vehicles and trains traveling on the track through communications with a centralized control office 260. The analyzer determines a plurality of track and vehicle parameters as described above. When the analyzer has determined a non-compliance geometry condition exists, after the analyzer has taken steps to protect vehicle 28, the analyzer notifies the centralized control office via the communications device 216 (e.g., cellular data modem).

The centralized control office 260 determines an appropriate action to be taken (e.g., initiate maintenance of the track defect, issue a slow order to future trains traveling over the same area until maintenance is completed). The slow order is ultimately communicated to analyzers 140, 200 in such trains so that recommended actions by the analyzer are determined in the context of the slow order. Additionally, the centralized control office may append the track defect and associated information from the analyzer to historical records of track defects, related problems, and associated maintenance actions. The centralized control office may then, with discretion, choose to send out maintenance personnel to verify and/or repair the specified track area.

In yet another aspect, the analyzers 140, 200 can dynamically model a behavior of each vehicle associated with a train or an autonomous vehicle traveling on a track. The analyzer includes a train manifest stored in the look-up table 226, which includes the train car sequence information. The train manifest is based on initial operation (startup) of the train. The train manifest can be downloaded into the look-up table using the communications device (e.g., cellular data modem) 216. Alternatively, the train manifest can be copies from removable storage media (e.g., floppy disk, CD-ROM, etc.) to the look-up table. The train manifest may even be entered manually using the keyboard and saved to the look-up table. The look-up table also includes physical car characteristics and a plurality of parameters describing the car handling situations (i.e., operating characteristics) for each vehicle of the train. The analyzer 140, 200 determines a plurality of track and vehicle parameters as described above. The computer system 218 performs a series of calculations to model each vehicle under current track geometry conditions. The analyzer determines a statistical probability of each vehicle causing a potential derailment situation based on the current conditions and identifies the vehicle with the highest probability. The analyzer determines if the highest probability of derailment exceeds a minimum acceptable probability. If the highest probability of derailment exceeds the minimum acceptable probability, the analyzer determines a recommended course of action to reduce the probability of derailment below the minimum acceptable probability. The track analyzer will notify the vehicle operator of the situation and recommended course of action via the video display device 142. The analyzer will also communicate the recommended course of action to the locomotive control computer 250 to change the current control strategy to reduce the probability of derailment. Once the high-risk vehicle has traveled beyond the identified risk area, the analyzer will further communicate a message to the locomotive control computer to resume standard train operations.

In dynamically modeling an autonomous vehicle, the look-up table 226 also includes recent historical geometric conditions of the upcoming track. The computer system 218 performs calculations to model the autonomous vehicle over the upcoming track using the historical track geometry conditions. The analyzer 140, 200 determines a statistical probability of the autonomous vehicle derailing based on the historical geometric conditions of the upcoming track. If necessary, the analyzer determines a recommended course of action to reduce the probability of derailment of the autonomous vehicle to below a minimum acceptable probability.

While the invention is described herein in conjunction with exemplary embodiments, it is evident that many alternatives, modifications, and variations will be apparent to those skilled in the art. Accordingly, the embodiments of the invention in the preceding description are intended to be illustrative, rather than limiting, of the spirit and scope of the invention. More specifically, it is intended that the invention embrace all alternatives, modifications, and variations of the exemplary embodiments described herein that fall within the spirit and scope of the appended claims or the equivalents thereof.

What is claimed is:

1. A track/vehicle analyzer included on a vehicle traveling on a track, the track/vehicle analyzer comprising:

a track detector for determining track parameters comprising at least one parameter of a group including a grade of the track, a superelevation of the track, a gauge of the track, and a curvature of the track;

a vehicle detector for determining vehicle parameters comprising at least one parameter of a group including a speed of the vehicle relative to the track, a distance the vehicle has traveled on the track, forces on a drawbar of the vehicle, a set of global positioning system coordinates for the vehicle, and a set of orthogonal accelerations experienced by the vehicle;

a computing device, communicating with the track detector and vehicle detector, for a) determining a plurality of calculated parameters as a function of the track parameters and the vehicle parameters, b) determining in real-time if the track parameters, the vehicle parameters, and the calculated parameters are within acceptable tolerances, and c) if any one of the track parameters, the vehicle parameters, or the calculated parameters are not within acceptable tolerances, generating corrective measures; and a communications device in communication with the computing device for communicating the corrective measures to a first locomotive control computer in a lead unit associated with the vehicle.

2. The track/vehicle analyzer set forth in claim 1 wherein the calculated parameters include a balance speed parameter for the vehicle and the computing device is also for determining in real-time if the track parameters, the vehicle parameters, and the calculated parameters associated with the balance speed parameter are within acceptable tolerances associated with the calculated balance speed parameter, and c) if any one of the track parameters, the vehicle parameters, or the calculated parameters associated with the balance speed parameter are not within acceptable tolerances associated with the balance speed parameter, determining a first optimized control strategy for the vehicle.

3. The track/vehicle analyzer set forth in claim 2 wherein the communications device is also for communicating the first optimized control strategy, the track parameters, the vehicle parameters, and the calculated parameters to the first locomotive control computer so that the first locomotive control computer can alter a current control strategy to promote operational safety and overall efficiency, including fuel efficiency, minimizing vehicle wheel wear, and minimizing track wear.

4. The track/vehicle analyzer set forth in claim 3 wherein the communications device receives feedback from the first locomotive control computer, including engine performance parameters and fuel consumption information, after the first locomotive control computer determines required alterations to the current drive control strategy based on any one or more of the first optimized control strategy, the track parameters, the vehicle parameters, and the calculated parameters.

5. The track/vehicle analyzer set forth in claim 4 wherein the computing device compares the feedback from the first locomotive control computer to any one or more of the first optimized control strategy, the track parameters, the vehicle parameters, and the calculated parameters to determine a second optimized control strategy and the communications device communicates the second optimized control strategy to the first locomotive control computer so that the first locomotive control computer can modify the control strategy alterations to further promote operational safety and overall efficiency, including fuel efficiency, further minimizing vehicle wheel wear, and further minimizing track wear.

6. The track/vehicle analyzer set forth in claim 1, the vehicle detector further comprising:

a force determiner for determining the forces on the drawbar of the vehicle.

7. The track/vehicle analyzer set forth in claim 6 wherein the communications device communicates the corrective measures to a second locomotive control computer in a helper unit of a train associated with the vehicle so that the second locomotive control computer can alter a current control strategy to promote operational safety and overall efficiency, including fuel efficiency, minimizing vehicle wheel wear, and minimizing track wear.

8. The track/vehicle analyzer set forth in claim 1 wherein the communications device communicates the corrective measures to a centralized control office thereby notifying the office that a defect has been detected in a portion of the track and providing the track parameters, the vehicle parameters, and the calculated parameters associated with the defective portion of the track so that the office can determine an appropriate action to be taken and maintain historical records of track defects.

9. The track/vehicle analyzer set forth in claim 8 wherein the communications device receives orders from the centralized control office after the office determines the appropriate action to be taken in response to the notice that the defect was detected.

10. The track/vehicle analyzer set forth in claim 1, wherein the vehicle is a first vehicle and is associated with a train or traveling on the track as an individual vehicle, the track/vehicle analyzer further including:

a look-up table, communicating with the computing device, for storing at least one of a group including a train manifest associated with the train, a plurality of physical characteristics for each vehicle, and a plurality of operating characteristics for each vehicle over a range of operational situations.

11. The track/vehicle analyzer set forth in claim 10, wherein the communications device receives at least one of a group including the train manifest, the plurality of physical characteristics for each vehicle, and the plurality of operating characteristics over a range of operational situations from a centralized control office for storage in the look-up table.

12. The track/vehicle analyzer set forth in claim 10 wherein the communications device is also for communicating with an upcoming track feature including a feature selected from a group including a track switch and a track crossing to determine the condition of the feature.

13. The track/vehicle analyzer set forth in claim 12 wherein the computing device a) dynamically models a behavior of each vehicle based on any one or more of the track parameters, the vehicle parameters, the calculated parameters, the train manifest, the plurality of physical characteristics, the plurality of operating characteristics, and the condition of upcoming track features, b) identifies a vehicle with the highest statistical probability for a derailment under the track parameters for portions of the track currently being traveled, c) determines if the highest statistical probability exceeds a minimum acceptable probability, and d) if the highest statistical probability exceeds the minimum acceptable probability, determines a recommended course of action, including an optimized control strategy, to reduce the probability of derailment.

14. The track/vehicle analyzer set forth in claim 13, further including:

a video display device communicating with the computing device, the computing device displaying the recommended course of action on the video display device for use by an operator associated with the first vehicle.

15. The track/vehicle analyzer set forth in claim 13 wherein the communications device communicates the recommended course of action to a locomotive control computer associated with the first vehicle so that the locomotive control computer can alter a current control strategy to reduce the probability of derailment.

16. The track/vehicle analyzer set forth in claim 15 wherein the computing device determines that the vehicle with the highest probability for derailment has passed a portion of the track associated with the previous recommended course of action, and the communications device communicates a message to resume standard operations to the locomotive control computer.

17. A method for improving operational safety and overall efficiency, including fuel efficiency, vehicle wheel wear, and track wear, for a track and a vehicle traveling on the track, comprising:

a) determining track parameters comprising at least one parameter of a group including a grade of the track, a superelevation of the track, a gauge of the track, and a curvature of the track;

b) determining vehicle parameters comprising at least one parameter of a group including a speed of the vehicle relative to the track, a distance the vehicle has traveled on the track, forces on a drawbar of the vehicle, a set of global positioning system coordinates for the vehicle, and a set of orthogonal accelerations experienced by the vehicle;

c) determining a plurality of calculated parameters as a function of the track parameters and the vehicle parameters, including a balance speed parameter for the vehicle;

d) determining in real-time if the track parameters, the vehicle parameters, and the calculated parameters associated with the balance speed parameter are within acceptable tolerances associated with the balance speed parameter;

e) if any one of the track parameters, the vehicle parameters, or the calculated parameters associated with the balance speed parameter are not within acceptable tolerances, determining a first optimized control strategy for the vehicle; and f) communicating the first optimized control strategy, the track parameters, the vehicle parameters, and the calculated parameters to a locomotive control computer in a lead unit associated with the vehicle so that the locomotive control computer can alter a current control strategy to promote operational safety and overall efficiency, including fuel efficiency, minimizing vehicle wheel wear, and minimizing track wear.

18. The method set forth in claim 17, further including:

g) receiving feedback from the locomotive control computer, including engine performance parameters and fuel consumption information, after the locomotive control computer determines the required alterations to the current drive control strategy based on any one or more of the first optimized control strategy, the track parameters, the vehicle parameters, and the calculated parameters.

19. The method set forth in claim 18, further including:

h) comparing the feedback from the locomotive control computer to any one or more of the first optimized control strategy, the track parameters, the vehicle parameters, and the calculated parameters;

i) determining a second optimized control strategy based on the comparison; and j) communicating the second optimized control strategy to the locomotive control computer so that the locomotive control computer can modify the control strategy alterations to further promote operational safety and overall efficiency, including fuel efficiency, further minimizing vehicle wheel wear, and further minimizing track wear.

20. A method for improving operational safety and overall efficiency, including fuel efficiency, vehicle wheel wear, and track wear, for a track and a train traveling on the track, comprising:

a) determining track parameters comprising at least one parameter of a group including a grade of the track, a superelevation of the track, a gauge of the track, and a curvature of the track;

b) determining train parameters associated with a vehicle of the train including forces on a drawbar of the vehicle;

c) determining a plurality of calculated parameters as a function of the track parameters and the train parameters;

d) determining in real-time if the track parameters, the train parameters, and the calculated parameters are within acceptable tolerances;

e) if any one of the track parameters, the train parameters, or the calculated parameters are not within acceptable tolerances, generating corrective measures; and f) communicating the corrective measures to a locomotive control computer in a helper unit of the train so that the locomotive control computer can alter a current control strategy to promote operational safety and overall efficiency, including fuel efficiency, minimizing vehicle wheel wear, and minimizing track wear.

21. The method set forth in claim 20, before step c) further including:

g) determining a set of orthogonal accelerations experienced by the vehicle;

h) determining if the orthogonal accelerations are within acceptable tolerances; and i) if any one orthogonal acceleration is not within acceptable tolerances, adjusting the track parameters and the train parameters to compensate for each orthogonal acceleration that is not within acceptable tolerances.

22. A method for improving operational safety for a track and multiple independent vehicles traveling on the track, comprising:

a) on a first vehicle traveling on the track, determining track parameters comprising at least one parameter of a group including a grade of the track, a superelevation of the track, a gauge of the track, and a curvature of the track;

b) on the first vehicle, determining vehicle parameters comprising at least one parameter of a group including a distance the first vehicle has traveled on the track and a set of global positioning system coordinates for the first vehicle c) determining a plurality of calculated parameters as a function of the track parameters and the vehicle parameters;

d) on the first vehicle, determining in real-time if the track parameters, the vehicle parameters, and the calculated parameters are within acceptable tolerances; and e) if any one of the track parameters, the vehicle parameters, or the calculated parameters are not within acceptable tolerances, transmitting a message from the first vehicle to a centralized control office to notify the office that defects have been detected in a portion of the track and provide the track parameters, the vehicle parameters, and the calculated parameters associated with the defective portion of the track.

23. The method set forth in claim 22, further including:

f) at the centralized control office, determining an appropriate action to be taken in response to the notice that the defect was detected based on any one or more of the track parameters, the vehicle parameters, and the calculated parameters received from the first vehicle.

24. The method set forth in claim 23 wherein the centralized control office determines that a maintenance action is required and that a slow order should be issued, further including:

g) at the centralized control office, transmitting a slow order to vehicles traveling on the track that are traveling through or approaching a portion of the track where the defect was detected prior to the maintenance action being completed.

25. The method set forth in claim 24, further including:

h) at the first vehicle, receiving the slow order from the centralized control office and adjusting the speed at which the first vehicle is traveling on the track according to the slow order.

26. The method set forth in claim 25, further including:

i) at the first vehicle, determining that the first vehicle and all vehicles associated with the first vehicle in a train have passed the portion of the track where the defect was detected;

j) at the first vehicle, transmitting a message to the centralized control office that the first vehicle and all vehicles associated therewith have passed the portion of the track where the defect was detected; and k) at the centralized control office, transmitting a message to the first vehicle to resume standard operations.

27. The method set forth in claim 24, further including:

h) at a second vehicle traveling on the track and approaching a portion of the track where the defect was detected, receiving the slow order from the centralized control office and adjusting the speed at which the second vehicle is traveling on the track according to the slow order.

28. The method set forth in claim 27, further including:

i) at the second vehicle, performing steps a) through d), confirming the defect detected in the portion of the track.

29. The method set forth in claim 27, further including:

i) at the second vehicle, performing steps a) through d), determining that the defect detected in the portion of the track is no longer present;

j) at the second vehicle, transmitting a message to the centralized control office that the defect detected in the portion of the track is no longer present; and k) at the centralized control office, confirming that the maintenance order for the defective portion of the track has been completed and transmitting a message to the second vehicle to resume standard operations.

30. The method set forth in claim 24, further including:

h) at the centralized control office, communicating a maintenance order to track maintenance personnel calling for verification of the defect reported by the first vehicle and, if necessary, repair of the track.

31. The method set forth in claim 22, further including:

f) at the centralized control office, appending a notice that the defect was detected and the track parameters and the vehicle parameters received from the first vehicle to historical records of detected defects.

32. A method for dynamically modeling a behavior for a vehicle associated with a train traveling on a track or for an individual vehicle traveling on the track, comprising:

a) identifying a train manifest for the train;

b) identifying a plurality of physical characteristics for each vehicle;

c) identifying a plurality of operating characteristics for each vehicle over a range of operational situations;

d) determining track parameters comprising at least one parameter of a group including a grade of the track, a superelevation of the track, a gauge of the track, and a curvature of the track;

e) determining vehicle parameters for a first vehicle comprising at least one parameter of a group including a speed of the first vehicle relative to the track, a distance the first vehicle has traveled on the track, forces on a drawbar of the first vehicle, a set of global positioning system coordinates for the first vehicle, and a set of orthogonal accelerations experienced by the first vehicle;

f) determining a plurality of calculated parameters to dynamically model the behavior of each vehicle based on any one or more of the track parameters, the vehicle parameters, the train manifest, the plurality of physical characteristics, and the plurality of operating characteristics;

g) identifying a vehicle with the highest statistical probability for a derailment under the track parameters for portions of the track currently being traveled;

h) determining if the highest statistical probability exceeds a minimum acceptable probability; and i) if the highest statistical probability exceeds a minimum acceptable probability, determining a recommended course of action, including an optimized control strategy, to reduce the probability of derailment.

33. The method set forth in claim 32, step d) further including:

j) communicating with an upcoming track feature including a feature selected from a group including a track switch and a track crossing to determine the condition of the feature; and step f) further including:

k) determining a plurality of calculated parameters to dynamically model the behavior of each vehicle based on any one or more of the track parameters, the vehicle parameters, the train manifest, the plurality of physical characteristics, the plurality of operating characteristics, and the condition of the upcoming track feature.

34. The method set forth in claim 32, further including:

j) displaying the recommended course of action on a video display device for use by an operator associated with the first vehicle.

35. The method set forth in claim 32, further including:

j) communicating the recommended course of action to a locomotive control computer associated with the first vehicle so that the locomotive control computer can alter a current control strategy to reduce the probability of derailment.

36. The method set forth in claim 35, further including:

k) determining that the vehicle with the highest probability for derailment has passed a portion of the track associated with the previous recommended course of action; and l) communicating a message to resume standard operations to the locomotive control computer.

* * * * *